US011020762B2

(12) United States Patent
Lutz et al.

(10) Patent No.: US 11,020,762 B2
(45) Date of Patent: Jun. 1, 2021

(54) COUPLING FOR THE CONNECTING OF LINES, POWDER COATING FACILITY INCLUDING THE COUPLING, AND METHOD FOR CLEANING OF THE POWDER COATING FACILITY

(71) Applicant: Wagner International AG, Altstatten (CH)

(72) Inventors: Gilbert Lutz, Kriessern (CH); Roman Schmid, Hinterforst (CH)

(73) Assignee: Wagner International AG, Altstatten (CH)

( * ) Notice: Subject to any disclaimer, the term of this patent is extended or adjusted under 35 U.S.C. 154(b) by 0 days.

(21) Appl. No.: 16/377,214

(22) Filed: Apr. 7, 2019

(65) Prior Publication Data

US 2019/0314844 A1 Oct. 17, 2019

(30) Foreign Application Priority Data

Apr. 12, 2018 (EP) ..... 18167080

(51) Int. Cl.

| | |
|---|---|
| ***B05B 12/14*** | (2006.01) |
| ***B05B 7/14*** | (2006.01) |
| ***B05D 7/00*** | (2006.01) |
| ***B08B 5/02*** | (2006.01) |
| ***B05C 19/04*** | (2006.01) |

(52) U.S. Cl.

CPC ..... *B05B 12/1409* (2013.01); *B05B 7/1404* (2013.01); *B05C 19/04* (2013.01); *B05D 7/542* (2013.01); *B08B 5/02* (2013.01)

(58) Field of Classification Search

None

See application file for complete search history.

(56) References Cited

U.S. PATENT DOCUMENTS

| | | | | |
|---|---|---|---|---|
| 6,705,545 | B1 | 3/2004 | Sroka | |
| 2017/0267386 | A1* | 9/2017 | Meleg | B08B 5/02 |

FOREIGN PATENT DOCUMENTS

| | | | |
|---|---|---|---|
| DE | 10 2015 102332 | A1 | 8/2015 |
| DE | 10 2016 118395 | A1 | 12/2017 |
| EP | 2 361 691 | A1 | 8/2011 |

OTHER PUBLICATIONS

Search Report for corresponding European App. No. 18167080.3, dated Aug. 16, 2018.

* cited by examiner

*Primary Examiner* — Jethro M. Pence

(74) *Attorney, Agent, or Firm* — Renner, Otto, Boisselle & Sklar, LLP

(57) ABSTRACT

A coupling is provided for the connecting of lines and includes a first coupling disc with first line connectors and a second coupling disc with second line connectors. Moreover, a first drive is provided in order to be able to move the two coupling discs axially with respect to each other. Moreover, a second drive is provided in order to be able to rotate the two coupling discs with respect to each other.

14 Claims, 16 Drawing Sheets

18WA003

4/16

COUPLING FOR THE CONNECTING OF LINES, POWDER COATING FACILITY INCLUDING THE COUPLING, AND METHOD FOR CLEANING OF THE POWDER COATING FACILITY

This application claims priority under 35 USC § 119 to European patent application number 18167080, filed on Apr. 12, 2018, the entire disclosure of which is incorporated herein by reference.

TECHNICAL FIELD

The invention relates to a coupling for the connecting of lines, in particular of lines conducting coating powder or compressed air. The invention also relates to a powder coating facility including a coupling of this type and to a method for cleaning of the powder coating facility.

DESCRIPTION OF RELATED ART

During the electrostatic coating of workpieces with coating powder, or powder for short, the powder is sprayed onto the workpiece to be coated by means of one or more powder applicators. Subsequently, the workpiece coated with powder is heated to melt the powder. Once the workpiece has cooled down, the powder forms a hard, closed cover layer on the workpiece. During the coating process, the workpieces to be coated usually reside in a powder coating booth, which shall hereinafter be referred to as booth or coating booth for short. The powder applicators are supplied with coating powder by one or more powder conveyors that can be situated in a powder center.

If workpieces are to be coated with a different coating powder than the one used earlier, the coating process is interrupted and a so-called powder change takes place. During a powder change, i.e. when, for example, a different type of powder or powder of a different color is to be sprayed, more or less comprehensive cleaning measures are required in order to remove residues of the previously used powder from the powder-conducting components of the facility. Manual cleaning of these components can take considerable time to accomplish. During the cleaning process, the facility is not available for the coating of workpieces. This has a negative effect on the production costs. It is another disadvantage of manual cleaning that the staff runs the risk of inhaling powder particles during the cleaning process. Moreover, it must be made sure that the cleaning is done thoroughly. If, for example, the powder-conducting lines between powder conveyor and powder applicators are not cleaned sufficiently, there may be an undesirable carry-over of color after a color change.

A fluids switch for switching between two different fluids is known from the prior art, EP 2 361 691 A1. The fluids switch comprises a feed plate with two fluid feed lines and a purging air feed that is arranged between the two fluid feed lines. Moreover, the fluids switch comprises a discharge plate that touches the feed plate and has two fluid return lines and a discharge line that is arranged between the two fluid return lines. The feed plate can be shifted relative to the discharge plate such that the two fluid feed lines and the purging air feed can be connected to the discharge line. This solution is disadvantageous in that powder may become deposited between the feed plate and the discharge plate. This is the case, in particular, when the feed plate and the discharge plate are being shifted towards each other. The powder that is being deposited between the plates can be removed only with difficulty and additional effort during the cleaning of the fluids switch. It is another disadvantage that the connectors on the feed plate cannot really be positioned exactly opposite from the connectors on the discharge plate. The connectors being more or less offset with respect to each other generates ledges and dead spaces, in which powder may be deposited.

SUMMARY OF THE INVENTION

It is an object of the invention to devise a coupling for the connecting of lines, a powder coating facility including the coupling as well as a method for the cleaning of the powder coating facility, in which the degree of automation during the cleaning is increased even more.

The object is met by a coupling for the connecting of lines having the features described herein.

The coupling according to the invention for the connecting of lines comprises a first coupling disc with first line connectors and a second coupling disc with second line connectors. Moreover, a first drive is provided in order to be able to move the two coupling discs axially with respect to each other. Moreover, a second drive is provided in order to be able to rotate the two coupling discs with respect to each other.

The object is also met by a powder coating facility that includes the coupling described above and has the features described herein.

The powder coating facility according to the invention comprises the coupling described above and a powder conveyor that is connected to one of the first line connectors of the coupling by means of a powder line. Moreover, a powder applicator is provided that is connected to one of the second line connectors of the coupling by means of a further powder line. Moreover, a compressed air purging line that is connected to the coupling is provided.

The object is also met by a method for cleaning of the powder coating facility described above having the features described herein.

The method according to the invention for cleaning of the powder coating facility described above comprises the following steps. The coupling discs are arranged appropriately with respect to each other such that the compressed air purging line is connected to the powder line by means of the coupling. In a further step, the powder line is purged in the direction of the powder conveyor by means of compressed air.

Advantageous developments of the invention are evident from the features described herein.

In one embodiment of the coupling according to the invention, the two coupling discs are arranged coaxially. This allows the coupling to have a simple and inexpensive design.

In another embodiment of the coupling according to the invention, the first coupling disc comprises first axial channels, which each are connected to one of the first line connectors each. The second coupling disc comprises second axial channels, which each are connected to one of the second line connectors each. One seal each is arranged between the first channels and the second channels.

In an additional embodiment of the coupling according to the invention, the seals are designed to be sleeve-shaped.

In a development of the coupling according to the invention, an axle attached to the first coupling disc is provided. The axle forms the rotary axis for the second coupling disc.

Another development of the coupling according to the invention provides an axle bearing between the axle and the second coupling disc. The axle bearing comprises an air purge system. By this means, the degree of automation can be increased further and the coupling can be kept cleaner.

In an additional development of the coupling according to the invention, at least a part of the first line connectors are arranged on a first pitch circle.

Moreover, the invention can provide the coupling according to the invention such that at least another part of the first line connectors are arranged on a second pitch circle, whereby the radii of the two pitch circles differ. By this means, the surfaces available on the two coupling discs can be utilized optimally.

It is of advantage for the first drive of the coupling according to the invention to comprise a pneumatic cylinder. A drive of this type can be manufactured easily and inexpensively. Moreover, a drive of this type can also be used in areas with an elevated explosion hazard.

It is also of advantage for the second drive of the coupling according to the invention to comprise a pneumatic cylinder. A drive of this type can be manufactured easily and inexpensively. Moreover, a drive of this type can also be used in areas with an elevated explosion hazard.

In the coupling according to the invention, at least a part of the first and/or of the second line connectors can be designed as hose nozzles.

A development of the coupling according to the invention provides the one coupling disc to comprise a positioning pin and the other coupling disc to comprise sockets for accommodation of the positioning pin. The positioning pin and the sockets help in accurately positioning the (axially) adjacent channels of the two coupling discs with respect to each other such that no dead space arises at the transition between the adjacent channels and the seals and such that no powder can be deposited in this place.

Another development of the coupling according to the invention has at least one spacer arranged between the two coupling discs.

In a development of the powder coating facility, the compressed air purging line is connected to one of the second line connectors of the coupling. Moreover, a further compressed air purging line connected to one of the first line connectors of the coupling is provided.

In a development of the method for cleaning of the powder coating facility, the coupling discs are arranged appropriately with respect to each other such that the further compressed air purging line is connected to the powder applicator by means of the coupling and the further powder line. In a further step, the further powder line is purged in the direction of the powder applicator by means of compressed air. By this means, the degree of automation of the cleaning can be increased even more and the period of time required for cleaning can be reduced even more.

BRIEF DESCRIPTION OF THE DRAWINGS

The invention and several exemplary embodiments are illustrated in more detail in the following based on 19 figures.

DETAILED DESCRIPTION OF THE INVENTION

Figure 1:
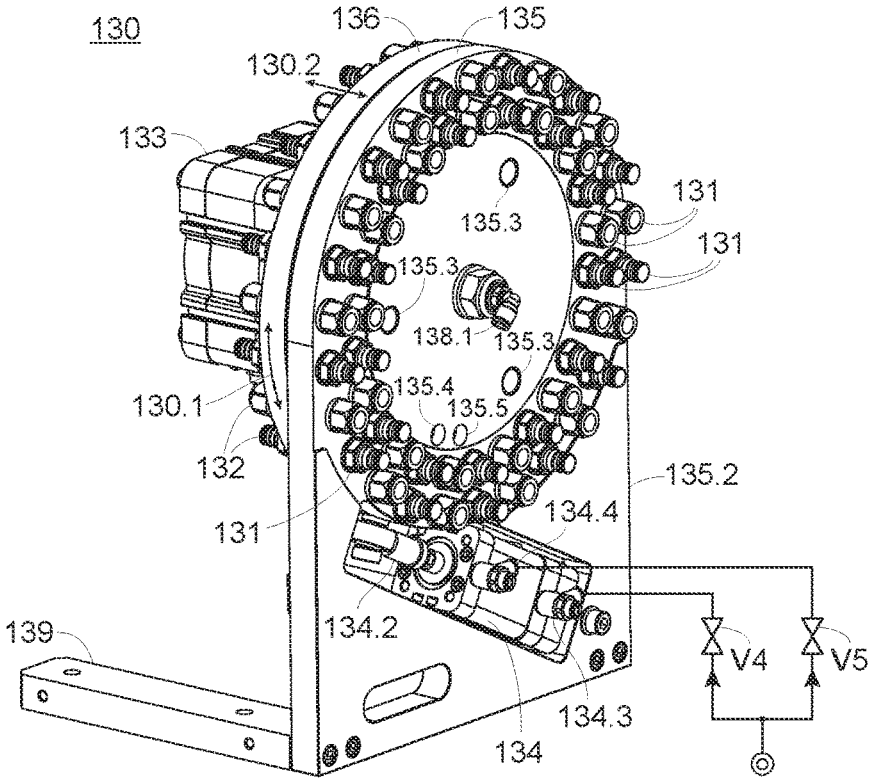
FIG. 1 shows a first three-dimensional view of a first possible embodiment of the coupling according to the invention for the connecting of lines.
Figure 2:
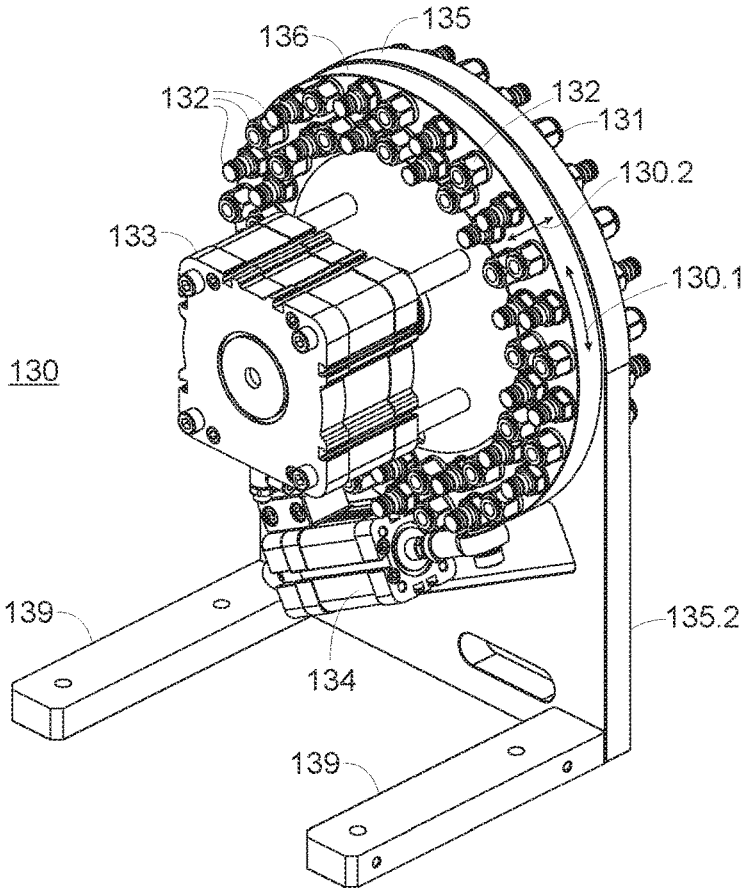
FIG. 2 shows a second three-dimensional view of the first embodiment of the coupling according to the invention.
Figure 3A:
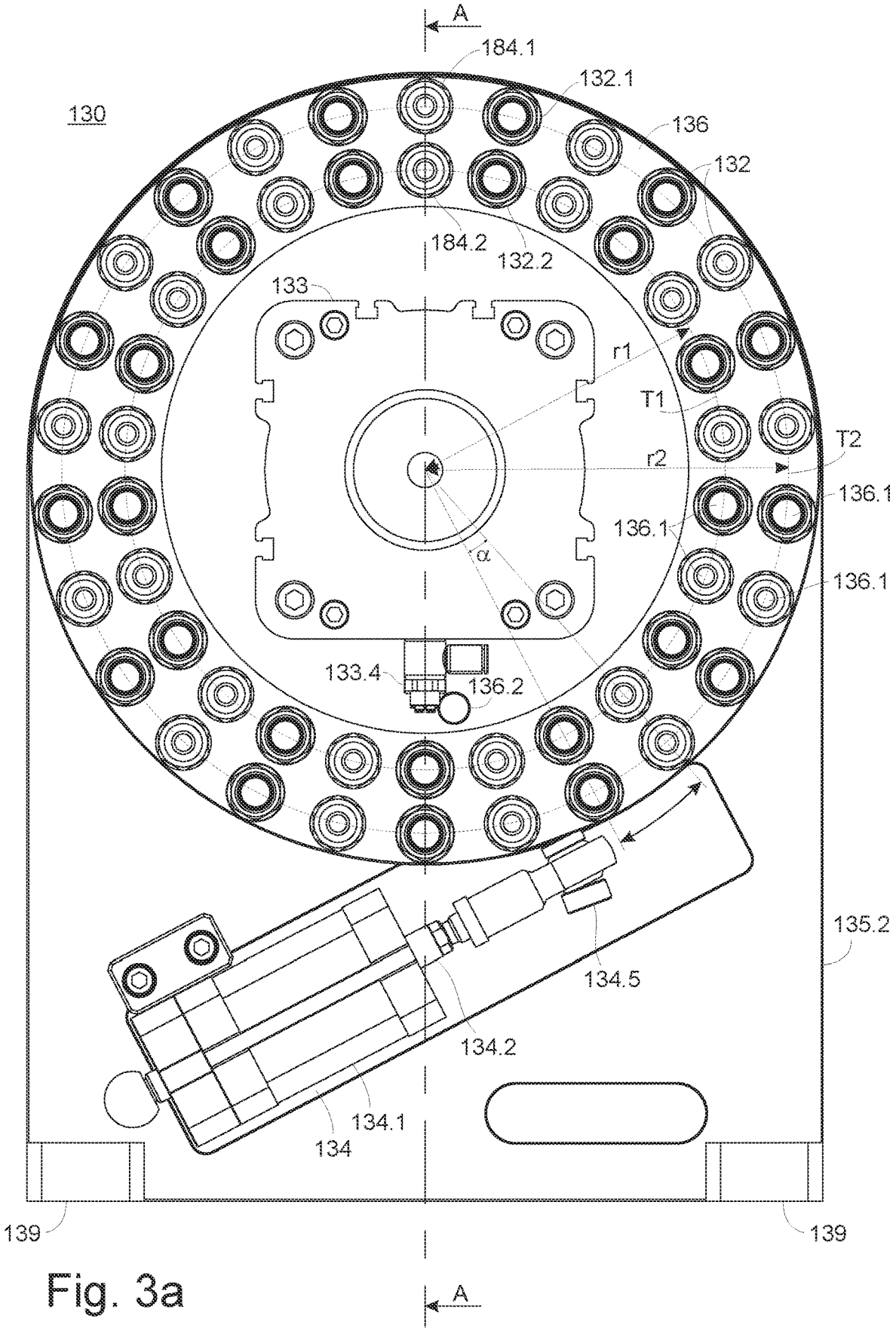
FIG. 3*a* shows a side view of the first embodiment of the coupling according to the invention.
Figure 4:
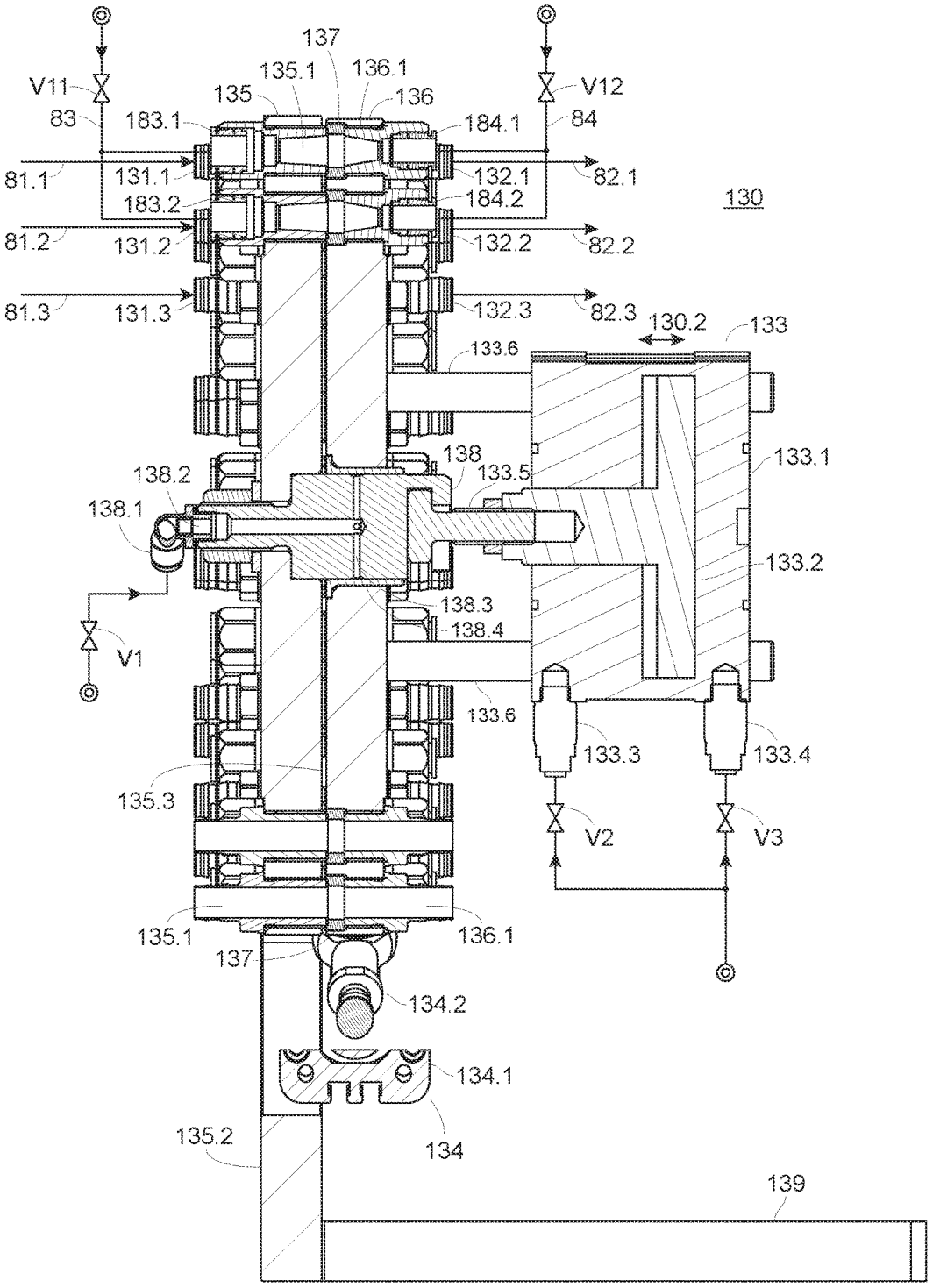
FIG. 4 shows a longitudinal section of the first embodiment of the coupling according to the invention.

FIGS. 1 and 2 show two different three-dimensional views of a first possible embodiment of the coupling 130 according to the invention for the connecting of lines. FIG. 3*a* shows a side view of the coupling 130 according to the invention and FIG. 4 shows a longitudinal view along the line A-A. The coupling 130 according to the invention comprises a first coupling disc 135 and a second coupling disc 136, which, preferably, are arranged such as to be concentric with respect to each other. Advantageously, the coupling disc 136 is designed to be round or even circular. The second coupling disc 136 is supported against the first coupling disc 135 such that it can be rotated. This is indicated by the double arrow 130.1. A drive 134 is provided to be able to rotate the second coupling disc 136. Moreover, the second coupling disc 136 can be moved in axial direction with respect to the first coupling disc 135 in translational manner. This is indicated by the double arrow 130.2 on the coupling disc 136. A drive 133 is provided to be able to move the second coupling disc 136 in axial direction.

The drive 133 can comprise a pneumatic cylinder 133.1. A piston 133.2 is situated on the inside of the pneumatic cylinder 133.1 and can be moved into a first position and into a second position by means of compressed air. For this purpose, the drive 133 comprises two compressed air connectors 133.3 and 133.4. The two compressed air connectors 133.3 and 133.4 can each be connected to a compressed air source by means of a valve V2 or V3 (see FIG. 4). When the valve V3 is closed and the valve V2 is open, the compressed air flows from the left into the cylinder 133.1 and presses the piston 133.2 towards the right. FIG. 4 shows the piston 133.2 in the right end position. In contrast, when the valve V2 is closed and the valve V3 is open, the compressed air flows from the right into the cylinder 133.1 and presses the piston 133.2 towards the left.

The piston 133.2 is connected to an axle 138 in form-fitting manner by means of a stud 133.5. For this purpose, the axle 138 can comprise a corresponding receptacle. The axle 138 is rigidly connected to the first coupling disc 135, for example by being screwed to it. The second coupling disc 136 is supported on the axle 138 by means of a bearing 138.4 such that it can rotate. The cylinder 133.1 is rigidly connected to the second coupling disc 136 by means of connecting rods 133.6.

When the piston 133.2 is being pushed to the left by compressed air, the two coupling discs 135 and 136 move away from each other. The stroke Δx, by means of which the coupling disc 136 moves away from the coupling disc 135, depends on the stroke of the pneumatic cylinder 133.1.

The first coupling disc 135 can be fitted, for example, with two sockets 135.4 and 135.5 and the second coupling disc 136 can be fitted with a positioning pin 136.2 that fits in the sockets 135.4, 135.5. The positioning pin 136.2 can be screwed into the coupling disc 136. When the coupling disc 136 moves away from the coupling disc 135, the positioning pin 136.2 is pulled out of the corresponding socket 135.4 or 135.5. When the piston 133.2 is being pushed to the right by compressed air, the two coupling discs 135 and 136 are pushed together and against each other again. In the course of this, the positioning pin 136.2 is plugged again into the corresponding socket 135.4 or 135.5 such that the two coupling discs 135 and 136 are accurately positioned with respect to each other. When the positioning pin 136.2 is being plugged into socket 135.4, the coupling disc 136 is situated in the first rotary position. In contrast, when the positioning pin 136.2 is being plugged into socket 135.5, the coupling disc 136 is situated in the second rotary position.

Like drive 133, drive 134 can also comprise a pneumatic cylinder 134.1. The drive 134 can be attached to a bracket 135.2. The bracket 135.2 and the first coupling disc 135 can be implemented by components that can be separated from each other, and the coupling disc 135 can be mounted to the bracket 135.2. However, the coupling disc 135 and the bracket 135.2 can be just one component. The coupling disc 135 can be partly round, as shown in FIG. 1. The coupling 130 can be fitted with leveling feet 139. A piston with a piston rod 134.2 is situated on the inside of the pneumatic cylinder 134.1 and can be moved into a first position and into a second position by means of compressed air. For this purpose, the drive 134 comprises two compressed air connectors 134.3 and 134.4. The two compressed air connectors 134.3 and 134.4 can each be connected to a compressed air source by means of a valve V4 or V5 (see FIG. 1). When the valve V4 is closed and the valve V5 is open, the piston is pushed into the cylinder 134.1 and/or the piston rod 134.2 is pulled into the cylinder. In contrast, when the valve V5 is closed and the valve V4 is open, the compressed air pushes the piston with the piston rod 134.2 out of the cylinder 134.1. The piston rod 134.2 is connected to the second coupling disc 136 by means of a hinge 134.5.

When the piston with the piston rod 134.2 is being pushed out of the cylinder 134.1 by means of compressed air, the coupling disc 136 rotates accordingly. The angle of rotation a, by which the coupling disc 136 rotates, depends on the stroke of the cylinder 134.1. When the piston with the piston rod 134.2 is being pulled into the cylinder 134.1 again by means of compressed air, the coupling disc 136 rotates by the angle of rotation a back into its original position.

The axle bearing, or bearing 138.4 for short, can, for example, take the shape of a socket, as is shown in FIG. 4. Preferably, it is fitted with an air purge system. The bearing 138.4 can be supplied with air for purging by means of the axle 138. In this case, the axle 138 comprises a compressed air connector 138.1 adjacent to which there is an air channel 138.2 that extends axially and, on the end of the air channel 138.2, an air channel 138.3 that extends radially.

Compressed air can flow into the two air channels 138.2 and 138.3 via a valve V1 that is connected to the compressed air connector 138.1. Once the air reaches the outer end of the radially extending air channel 138.3, it flows along between the axle 138 and the bearing 138.4 and removes any powder that may have been deposited in this location.

Preferably, the two coupling discs 135 and 136 are arranged coaxially, on the same axis 138. The axis 138 is the bearing axis of the coupling disc 135 and the rotation axis of the coupling disc 136.

The first coupling disc 135 can comprise a series of line connectors 131. The series of line connectors 131 shall also be referred to as first group of line connectors 131 hereinafter. If the line connectors 131 are to be connected to a compressed air line 83, they can be designed as compressed air connectors 183.1 to **183.*n*. If the line connectors 131 are to be connected to powder lines 81.1, 81.2 . . . 81.*n*, they can be designed as hoses nozzles 131.1, 131.2, . . . 131.*n***, whereby n means any number of line connectors and/or lines.

The same applies analogously to the second coupling disc 136. Accordingly, the second coupling disc 136 can comprise a series of line connectors 132. The series of line connectors 132 shall also be referred to as second group of line connectors 132 hereinafter. If the line connectors 132 are to be connected to compressed air lines 84, they can be designed as compressed air connectors 184.1 to **184.*n*. If the line connectors 132 are to be connected to powder lines 82.1, 82.2, . . . 82.*n*, they can be designed as hose nozzles 132.1, 132.2, . . . 132.*n***.

The line connectors 131 of the first coupling disc 135 can be distributed over a first pitch circle T1 with a radius of r1 and over a second pitch circle T2 with a radius of r2 (see FIG. **3*a*). The same applies analogously to the line connectors 132 of the second coupling disc 136. In the embodiment shown in FIGS. 1, 2, 3*a*, and 4, a total of 52 line connectors 131 are present on the first coupling disc 135 and also a total of 52 line connectors 132 are present on the second coupling disc 136. A total of 26 of the line connectors 132 are situated on the first pitch circle T1. A total of 26 further line connectors 132 are situated on the second pitch circle T2. Preferably, the line connectors 131 are arranged in the same way and manner as the line connectors 132. The two pitch circles T1 and T2** are preferably arranged such as to be concentric.

When the piston rod 134.2 is in the position shown in FIG. **3*a*, the line connector 184.1 is connected to the line connector 183.1. Moreover, the line connector 184.2 is connected to the line connector 183.2, the line connector 132.1 is connected to the line connector 131.1, and the line connector 132.2 is connected to the line connector 131.2. The same applies analogously to the remaining line connectors 184.3 . . . 184.*n*, 132.3 . . . 132.*n*, 183.3 . . . 183.*n*, and 131.3 . . . 131.*n*. Accordingly, by means of the coupling 130**, two of the line connectors each can be connected to each other via a channel that is situated in the coupling discs.

For this purpose, 26 channels 135.1 that extend axially are situated on the first pitch circle T1 in the first coupling disc 135. A total of 26 further channels 135.1 that extend axially are situated on the second pitch circle T2. Each of the channels 135.1 is assigned to one of the line connectors 131. The second coupling disc 136 is identical in structure in this regard. Accordingly, there are 26 channels 136.1 that extend axially on the first pitch circle of the second coupling disc 136. A total of 26 further channels 136.1 that extend axially are situated on the second pitch circle T2. Each of the channels 136.1 is assigned to one of the line connectors 132.

When the coupling discs 135 and 136 are pressed against each other, the channels 135.1 of the first coupling disc 135 and the channels 136.1 of the second coupling disc 136 each are connected to each other in pairs. The transition from one channel 135.1 to the adjacent channel 136.1 is preferably fitted with a seal 137. This applies to all transitions between two channels 135.1 and 136.1. The seals 137 preferably take the shape of a sleeve.

Spacers 135.3 can be provided between the two coupling discs 135 and 136. These can be attached, for example, to the coupling disc 135 (see FIG. 1). For this purpose, the coupling disc 135 can comprise threaded holes into which the spacers 135.3 are screwed. When the two coupling discs 135 and 136 are pushed against each other (see, for example, FIG. 4), the spacers 135.3 between the two coupling discs 135 and 136 make sure that the seals 137 are not being pushed together too firmly such that they would be damaged.

When powder is being conveyed via the powder line 81.1, it gets into the powder line 82.1 via the connector 131.1, the corresponding channel 135.1 of the coupling disc 135, the corresponding channel 136.1 of the coupling disc 136, and the connector 132.1. When powder is being conveyed via the powder line 81.2, it gets into the powder line 82.2 via the connector 131.2 and the corresponding channel 135.1 of the coupling disc 135, the corresponding channel 136.1 of the coupling disc 136, and the connector 132.2.

The coupling 130 works as follows. In a first step, the drive 133 is used to place the second coupling disc 136 at a distance Δx from the first coupling disc 135 and, in the process, the positioning pin 136.2 is pulled, for example, out of the one socket 135.4. In a second step, the coupling disc 136 is rotated by the angle of rotation a from a first rotary position into a second rotary position. For this purpose, the piston rod 134.2 is pushed out of the cylinder 134.1. Subsequently, the drive 133 is used to move the second coupling disc 136 back to the first coupling disc 135 and to press it against said disc. In this context, the positioning pin 136.2 is now being plugged into the other socket 135.5. The positioning pin 136.2 and the sockets 135.4 and 135.5 help in accurately positioning the adjacent channels 135.1 and 136.1 with respect to each other such that no dead space arises at the transition between the adjacent channels 135.1 and 136.1 and the seals 137 and such that no powder can be deposited in this place.

Once valve V12 is being opened, compressed air flows via the line 84, the connector 184.1, the corresponding channel 136.1 of the coupling disc 136, the corresponding channel 135.1 of the coupling disc 135, and the connector 131.1 into the powder line 81.1. Moreover, compressed air also flows via the line 84 through the connector 184.2, the corresponding channel 136.1 of the coupling disc 136, the corresponding channel 135.1 of the coupling disc 135, and the connector 131.2 into the powder line 81.2. The same applies analogously to the remaining connectors and lines. By this means, powder can be removed from the powder lines 81 by means of compressed air.

Powder can also be removed from the powder lines 82 by means of compressed air. For this purpose, the valve V11 is being opened such that compressed air flows via the line 83, the connector 183.1, the corresponding channel 135.1 of the coupling disc 135, the corresponding channel 136.1 of the coupling disc 136, and the connector 132.1 into the powder line 82.1, and such that the powder present there is transported out of the line 82.1 in the direction of the powder applicator 80. The same applies analogously to the remaining connectors and lines.

Once the powder lines have been purged, the second coupling disc 136 is moved away from the first coupling disc 135. Then the coupling disc 136 is rotated back into its original rotary position, is moved to the first coupling disc 135 again, and is pushed against said disc. Subsequently, the powder lines are available again for powder coating operation.

Further Embodiments

Basically, the connectors 131 and 132 of the first and second coupling discs 135 and 136 can be configured as desired. Accordingly, the lines 83 can be designed, for example, as further powder lines rather than compressed air lines. In this case, powder of a first color can be transported in the powder lines 81 and powder of a second color can be transported in the lines 83. By rotating the coupling disc 136, the pairings of the connectors 131 and 132 can be changed quickly such that a quick and simple color change between the first and the second color can take place.

Figure 3B:
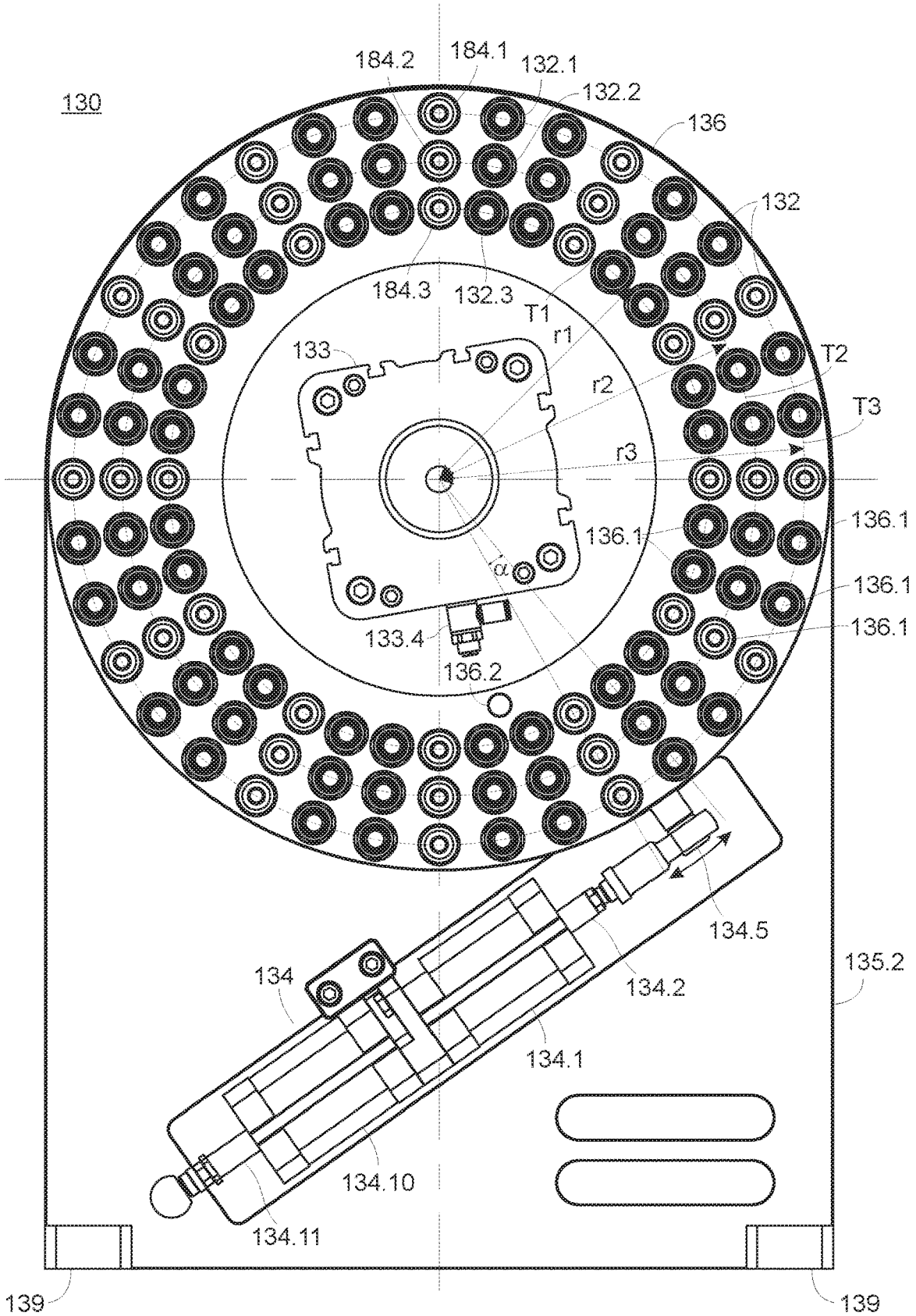
FIG. 3*b* shows a side view of the second embodiment of the coupling according to the invention.

The coupling disc 136 can just as well be rotated by a multiple of the angle of rotation a such that more than two rotary positions can be reached. The embodiment shown in FIG. 3*b* is one example of this. By this means, for example additional colors can be added and a rapid and simple color change between the colors can take place in the manner described above.

The invention can just as well provide, for example, the coupling disc 136 to take on three different rotary positions: With, for example, the angle of rotation being 0° in the first position, the angle of rotation being a in the second position, and the angle of rotation being 2*a in the third position. By this means, in the first position, powder of a first color could be transported. In the second position, the powder-conducting lines can be cleaned with compressed air. In the third position, powder of a second color can be transported.

For the coupling disc 136 to be able to assume all three different rotary positions, a drive 134 with two pneumatic cylinders 134.1 and 134.10 is present in the embodiment shown in FIG. 3*b*. The two pneumatic cylinders 134.1 and 134.10 are arranged one after the other. The piston rod 134.11 of the pneumatic cylinder 134.10 rests against the bracket 135.2. The piston rod 134.2 of the pneumatic cylinder 134.1 is connected to the second coupling disc 136 by means of the hinge 134.5.

By means of the pneumatic cylinder 134.10, the pneumatic cylinder 134.1, and thus the coupling disc 136, can be transitioned into a first and a second position. By means of the pneumatic cylinder 134.10, the coupling disc 136 can be transitioned into the third position. If the pistons 134.2 and 134.11 of the two pneumatic cylinders 134.1 and 134.10 are retracted, the coupling disc 136 is in its first rotary position. The coupling disc 136 can be transitioned into the second rotary position by driving out the piston rod 134.2 of the pneumatic cylinder 134.1 or the piston rod 134.11 of the pneumatic cylinder 134.10. In order to transition the coupling disc 136 into the third rotary position, both the piston rod 134.2 of the pneumatic cylinder 134.1 and the piston rod 134.11 of the pneumatic cylinder 134.10 are driven out.

The number of the connectors 131 and 132 and the number of the pitch circles can also be changed and adapted to the pertinent needs. Accordingly, for example in the embodiment of the coupling 130 shown in FIG. 3*b*, three pitch circles T1, T2, and T3 with radii of r1, r2, and r3 are present on the first and the second coupling discs 135 and 136. The coupling 130 according to FIG. 3*b* comprises 36 line connectors 135 and/or 136 per pitch circle.

The layout of the entire powder coating facility is illustrated in more detail in the following based on FIGS. 5 to 18.

The powder center 1, also referred to as powder supplying device, powder center or integrated powder management system, comprises a powder reservoir container 3 that is used for storing the coating powder. Moreover, the powder center 1 comprises a powder conveying device 1.1 by means of which the powder is conveyed out of the powder reservoir container 3 and is transported to a powder applicator 80. The powder conveying device 1.1 is integrated into the powder reservoir container 3 in the present case and shall be illustrated in more detail later on. The powder applicator 80 (see FIG. 5) can be designed as a manual or automatic powder spraying device and comprises, on its outlet facing the workpiece 65, a spray nozzle or a rotation atomizer.

The powder center 1 is designed as a module. By this means, the powder center 1 can be transported rapidly and easily as a compact unit. The individual components of the powder center 1 are attached to frame profiles 2 that can be made of aluminum or steel, for example. The frame profiles 2 form the outer boundary of the powder center 1. In case of need, the powder center 1 can comprise a base 7.

The powder reservoir container 3 of the powder center 1 can be arranged, for example, on a pedestal 6. As shown, for example, in FIG. 11, the powder reservoir container 3 can be closed off by a powder container lid 23 during conveying mode. In the embodiment shown in FIGS. 6 to 14, the powder container lid 23 takes the shape of an inverted pot. By means of pneumatic locks 18, the powder container lid 23 can be closed off tightly against the powder reservoir container 3. For this purpose, the powder reservoir container 3 comprises seals and lock receptacles 3.1 that can be engaged by appropriately designed counterparts of the pneumatic lock 18. The pneumatic lock 18 can be fitted, for example, with a cylinder, a piston, and a piston rod. When compressed air is being applied to the lower chamber of the cylinder, the piston and thus the piston rod are pushed upwards. The grab situated on the lower end of the piston rod engages the lock receptacle 3.1 and causes the powder container lid 23 to be pushed onto the powder reservoir container 3. Three locks 18 of this type are present in one embodiment (for example shown in FIGS. 8 and 9). The number of locks 18 as well as their design can be readily adapted to the respective needs.

A screen 24, which can be designed as an ultrasound screen, is situated on the inside of the powder reservoir container 3. The ultrasound transducer 24.1 of the screen 24 is preferably situated outside the powder reservoir container 3. The screen 24 is accessible and can be taken out once the powder container lid 23 is taken off. For this to take place automatically, the ultrasound screen 24 is attached to a pivoting mechanism 16 by means of a support arm 22. Using the pivoting mechanism 16, the screen 24 can be pivoted out of the working position (see FIG. 8) and can be moved into a cleaning position in a cleaning station 27 (see FIG. 14). The cleaning station 27 shall also be referred to as screen cleaning station or screen-cleaning station hereinafter.

Figure 10:
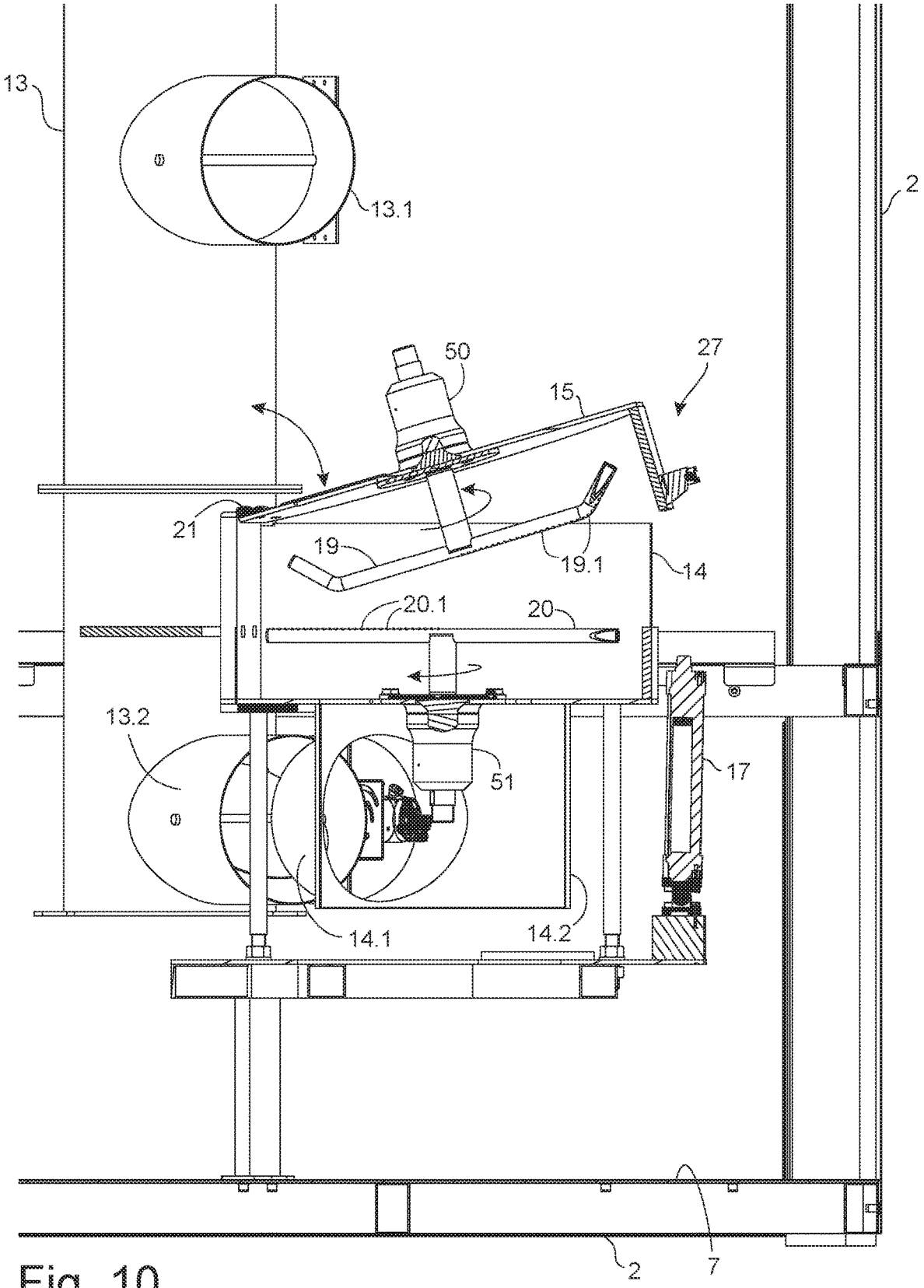
FIG. 10 shows a magnified sectioned view from the side of a part of the powder center according to the invention with the screen cleaning device.

As shown in FIG. 10, a cleaning arm 20, which is supported such that it can rotate, is situated on the inside of the cleaning station 27. The cleaning arm 20 comprises a multitude of cleaning nozzles 20.1, which are arranged on the top side of the cleaning arm 20. The cleaning station 27 also comprises a lid 15 that can be opened and closed, for example, by means of a pneumatic cylinder 17. The lid 15 is pivoted about a hinge 21 in this context. A curved double arrow indicates the pivoting motion. The lid 15 bears, on its underside, a cleaning arm 19, which is also fitted with a multitude of cleaning nozzles 19.1.

The cleaning nozzles 19.1 are preferably situated on the underside of the cleaning arm 19. They are aligned appropriately such that they blow compressed air downwards onto the ultrasound screen 24, which is situated below the cleaning arm 19, during cleaning mode. The upper cleaning arm 19 is supported on the lid 15, such that it can rotate, by a bearing 50. The lower cleaning arm 20 is supported on the cleaning container 14, such that it can rotate, by a bearing 51. The two bearings 50 and 51 can just as well be designed in the form of air motors. The direction of rotation of the upper cleaning arm 19 and the direction of rotation of the lower cleaning arm 20 are each indicated by an arrow. The direction of rotation of the cleaning arm results from the offset arrangement of the cleaning nozzles and the recoil that arises when compressed air flows out through the nozzles. During cleaning mode, the ultrasound screen 24 is situated between the lower cleaning arm 20 and the upper cleaning arm 19.

The cleaning arm 19 can be angled on both ends (as shown in FIG. 10) such that it has a horizontal leg and two legs that are slanting upwards. The compressed air nozzles 19.1 can just as well be situated on the horizontal leg and on the legs slanting upwards. The cleaning arm 19 can be designed in the form of a tube for guiding the compressed air on the inside of the tube to the compressed air nozzles 19.1. The same applies analogously to the lower cleaning arm 20, even though the ends of the lower cleaning arm 20 are not angled in FIG. 10.

A lower container section 14.2 with an outlet 14.1 for accommodating the screen 24 is situated on the underside of the container 14. The outlet 14.1 can be used to aspirate the powder-air mixture that is present in the cleaning station 27. For this purpose, the outlet 14.1 is connected to an inlet opening 13.2 of a suction tube 13 by means of a hose that is not shown in the figures. The powder-air mixture can be suctioned via the suction tube 13 and a suction line 91 into an after-filter 100.

The powder inlet of the working container 3, 23 is preferably situated in the upper part thereof. For example, it can be arranged in the powder container lid 23 of the working container 3, 23. The working container 3, 23 can just as well comprise multiple powder inlets. The powder inlet 23.1 is connected to the powder outlet 4.2 of an intermediate container 4 by means of a powder valve M21, which can be designed, for example, in the form of a pneumatically controlled crusher. The intermediate container 4, combined with the inlet valve M20 and the outlet valve M21, serves as powder conveyor 4 and is usually arranged above the working container 3, 23. By this means, gravity can be used to transport powder that is situated in the intermediate container 4 downwards into the working container 3, 23.

A second powder conveyor 5 can be arranged above the working container 3, 23. The powder outlet thereof also merges into the working container 3, 23. The second powder conveyor 5 can be identical in structure to the first powder conveyor 4.

The powder conveying device 1.1 that is integrated into the powder reservoir container 3 shall be illustrated in more detail in the following. The powder conveying device can be designed in the way described in European patent application EP 3 238 832 A1. The working container 3, 23 is designed and can be operated appropriately such that pressure can be applied to it. Powder can be conveyed out of the fresh powder station 30 and can be transported into the working container 3, 23 by means of the powder conveyor 4. A corresponding powder inlet is present in the powder container lid 23 that covers the powder reservoir container 3 on the top. The working container 3, 23 comprises, in the area of the container base 25, a fluidizing insert 25.1 for fluidizing the powder, and a series of powder outlets 3.2. The invention can provide one powder outlet valve G1-G36 to be connected to each of the powder outlets 3.2. In turn, one powder line 81 each is connected to each of the powder outlet valves G1-G36. Moreover, each of the powder lines 81 (81.1 . . . 81.*n*) comprises an inlet for transport air on the inlet side, i.e. in the proximity of the corresponding powder outlet valve G1-G36. On the outlet side, each of the powder lines 81 is preferably connected to one of the powder applicators 80 each by means of the coupling 130 described above and the powder lines 82 (82.1 . . . 82.*n*). The amount of powder to be conveyed is controlled by repeatedly opening and closing the corresponding powder outlet valve G1-G36 by means of a controller 70. To avoid repetitions, reference shall be made to the aforementioned patent application EP 3 238 832 A1, the content of which shall herewith be made a part of the present application.

Figure 11:
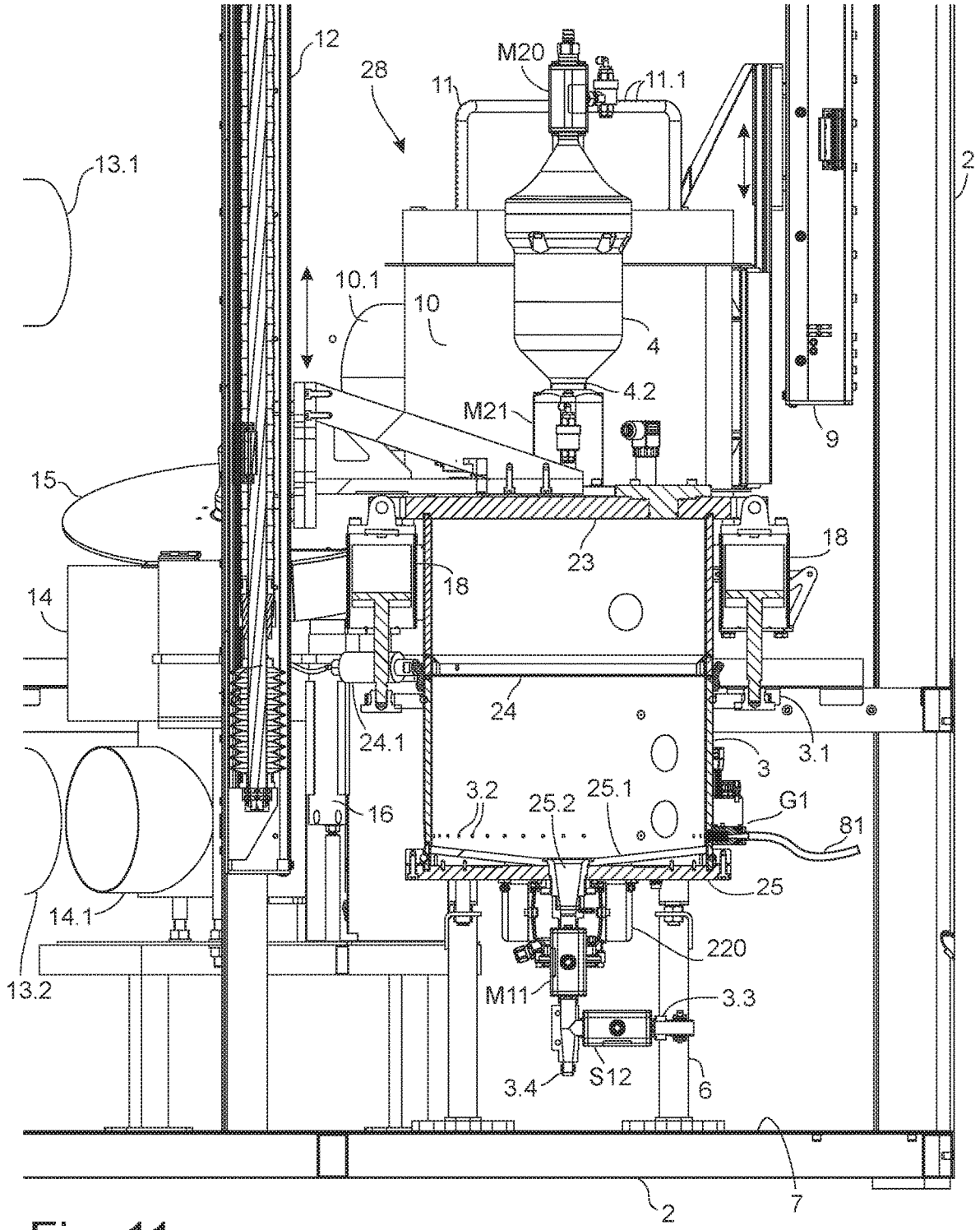
FIG. 11 shows a magnified sectioned view from the side of another part of the powder center according to the invention with the container cleaning facility.

An embodiment of the working container 3, 23 provides a vibrator 220 that can be situated, for example, below the powder reservoir container 3 (see FIG. 11). The shaking motions generated by the vibrator 220 can be used to fluidize the powder-air mixture in the powder reservoir container 3 even more homogeneously. Moreover, by this means, the powder-air mixture can flow even more optimally out of the powder outlet channel 203.

The coupling 130 comprises the first group of connectors 131 on the one coupling disc 135 and the second group of connectors 132 on the second coupling disc 136. The controller 70 can be used to adjust which connector of the first group 131 is connected to which connector of the second group 132. Accordingly, each individual powder line 81 can be connected, on the outlet side, to one convector of the first group 131 each. Each individual powder line 82 can be connected to a connector of the second group 132 each, and can be connected, on the other side, to one of the powder applicators 80 each.

In one embodiment, 36 powder outlet valves G1-G36 are used. However, more or fewer powder outlet valves can be used just as well. The number of powder outlet valves that is used depends on the number of powder applicators 80 that are used.

As an alternative to the integrated powder conveying device with the power outlet valve G1 just described, the invention can just as well provide a powder injector that works according to the Venturi principle or a powder pump for dense phase conveying.

Instead of the powder conveyor 4, a powder pump for dense phase conveying, a hose pump or a powder injector can just as well be provided. The same shall apply to the powder conveyor 5 analogously.

The powder reservoir container 3 and the powder container lid 23 thereof as well as the two powder conveyors 4 and 5 are attached to a vertical linear axle 12 and can be moved up and down by this device. The drive 12.1 of the linear axle 12 can be situated on the top of the linear axle 12. The direction of motion thereof is indicated by the vertical double arrow in FIG. 11.

In addition, the powder center 1 comprises a container cleaning unit 28, or cleaning unit for short, that comprises a cleaning container 10, an upper cleaning arm 11, and a lower cleaning arm 26. The upper cleaning arm 11 and the lower cleaning arm 26 are supported in the cleaning container 10 such that they can rotate and each comprise a multitude of compressed air-operated cleaning nozzles 11.1 or 26.1. The cleaning container 10 is attacked to a linear drive 9 and can be moved vertically upwards and downwards (in y direction) by the drive. The direction of motion thereof is indicated by the vertical double arrow in FIG. 11. The drive 9.1 of the linear drive 9 can be situated on the top of the linear drive 9. The linear drive 9, in turn, is attached to a horizontally-aligned linear drive 8 (also referred to as linear axle) and can be moved horizontally (in x direction) back and forth by same. The drive 8.1 of the linear axle 8 can be situated on the side of the linear axle 8. It is possible, by means of the linear axle 8, to position the container cleaning unit 28 laterally next to the working container 3, 23 (see FIGS. 6 to 9) during conveying mode. During cleaning mode, the container lid 23 is driven upwards first; then the container cleaning unit 28 can be positioned appropriately by means of the two linear drives 8 and 9 such that the cleaning container 10 is first moved over the powder reservoir container 3 and is then lowered to the extent such that the cleaning arm 26 is situated at a defined distance from the base 25 of the powder reservoir container 3. The cleaning arm 26 projecting on the bottom from the cleaning container 10 is then situated inside the powder reservoir container 3 and serves for cleaning the inner wall and the base 25 of the powder reservoir container 3.

The linear drive 12 can then be used to lower the powder container lid 23 to the extent such that the cleaning arm 11 that projects on the top from the cleaning container 10 can be used to blow off, and thus clean, the inner surfaces of the powder container lid 23. The cleaning arm 11 projects into the inside of the powder container lid 23 in this context.

One possible embodiment of the fresh powder station 30 is shown in various views in FIGS. 15 to 18.

Figure 17:
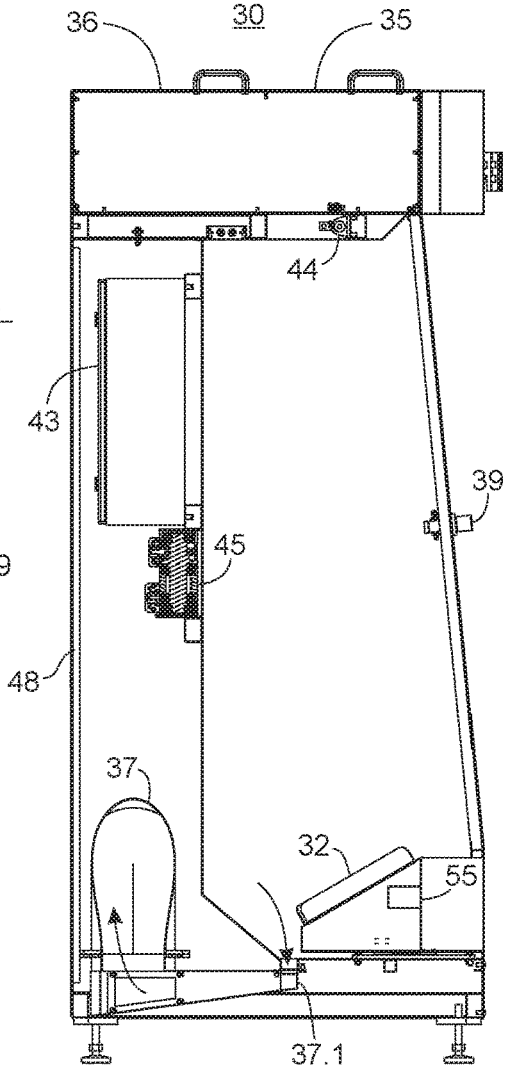
FIG. 17 shows a sectioned side view of the fresh powder station.
Figure 18:
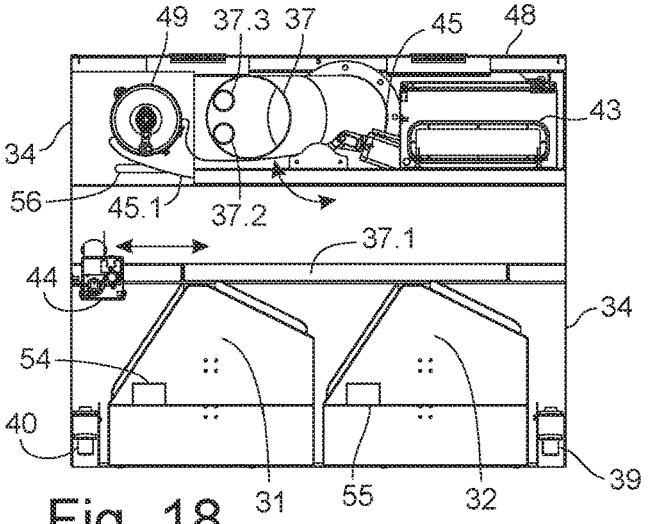
FIG. 18 shows a sectioned top view of the fresh powder station.

The fresh powder station 30 can be designed, for example, as an independent module. The station comprises a first storage space 31 and a second storage space 32, which each can accommodate a powder carton 110, 111 (see FIG. 5). The two storage spaces 31 and 32 are preferably arranged such as to be slanted such that the powder migrates obliquely downwards into a corner in the powder carton supported by gravity. By this means, the powder carton can be readily emptied by means of a suction lance 33 without any residue or hardly any residue being left behind. As shown in FIGS. 17 and 18, the suction lance 33 can be moved horizontally by means of a linear drive 44 such that it can be used for both a powder carton that is arranged on the first storage space 31 as well as for a powder carton that is arranged on the second storage space 32. Moreover, the fresh powder station 30 comprises an additional linear drive 38 to be able to move the suction lance 33 vertically as well.

A vibrator 54 and a scale 46 are situated below the storage space 31 for the powder carton 110. The purpose of the vibrator 54 is to agitate the powder in the carton 110 such that it is distributed better and flows in the direction of the suction lance 33.

The scale 46 can be used to determine the filling level in the carton 110, and to initiate a change of powder cartons once the filling level drops below a certain level. Moreover, the measuring signal generated by the scale 46 can be used to recognize if there is still sufficient space in the carton 110 when powder is to be conveyed via the line 96 from the powder center 1 back to the powder station 30.

Likewise, a vibrator 55 and a scale 47 are situated below the storage space 32. Their purpose is analogous to that of the vibrator 54 and of the scale 46 in the case of storage space 31.

To be able to clean the suction lance 33, the fresh powder station 30 comprises, in addition, a cleaning station 52 that is equipped with a wiper ring and/or compressed air nozzles and/or a suction system. By this means, powder adhering to the outside of the suction lance 33 can be removed during the up and down motion.

In addition, air nozzles 57 can be provided on the cleaning station 53 for cleaning of the lower area of the suction lance 33. If the suction lance 33 comprises a fluidizing crown for fluidizing the powder in the suction area, same can be cleaned with this as well.

Instead of two storage spaces 31 and 32 with two powder cartons 110 and 111, just one storage space 32 and a powder container 150 with a fluidizing facility could be installed just as well. For example, two pumps 124 and 125 could be used to convey powder from a Big Bag 121 into the powder container 150 via a powder line 127 each.

Instead of or in addition to the Big Bag 121, a Big Bag 120 with a pump 123 could be provided just as well. The powder can be pumped via a powder line 126 directly to the powder conveyor 4 by a pump 123.

The Big Bag 120 or 121 is also referred to as Flexible Intermediate Bulk Container or FIBC, for short. It usually contains larger amounts of powder than the powder carton 110 and the powder carton 111. Moreover, the Big Bag 120/120 usually stands farther away from the powder conveyor 4 than the powder carton 110 or 111. Accordingly, the Big Bag 120/121 can stand at a distance of, for example, 30 m from the powder conveyor 4, whereas the powder carton 110 or 111 stands, for example, at a distance of 5 m from the powder conveyor 4.

The fresh powder station 30 can comprise multiple compressed air regulating valves 39 and 40 and adjusting knobs 41 and 42. The compressed air regulating valve 39 can be designed for adjusting the fluid air of the fluid base of the powder container 150. The purpose of the compressed air regulating valve 40 is to adjust the fluid air at the fluidizing crown of the suction lance 33. The adjusting knob 41 can be used to control the position of the exhaust air damper. The adjusting knob 42 can be used to transmit a confirmation signal to the controller.

The fresh powder station 30 can comprise, in its base area, a suction system 37 with a suction opening 37.1 to be able to aspirate excess powder out of the inside of the fresh powder station 30. The fresh powder station 30 can also comprise a flexible suction hose that can be used for manual cleaning in case of need.

The invention can provide the fresh powder station 30 to comprise a pivoting mechanism 45 for the powder conveyor 49. The pivoting mechanism 45 comprises a drive, which can, for example, be designed as a pneumatic drive, and a pivoting arm 45.1. The pivoting mechanism 45 can be used to transition the powder conveyor 49 (see FIG. 15) out of the conveying position into a cleaning position. In the cleaning position, the powder conveyor 49 projects into the interior space of the fresh powder station 30. In addition, air nozzles 56 can be provided for cleaning of the lower area of the powder conveyor 49 when it is being pivoted out of the conveying position into the cleaning position or out of the cleaning position into the conveying position.

The pneumatic drive can comprise two pneumatically driven cylinders. By this means, the powder conveyor 49 can be transitioned into a cleaning position, a first conveying position, and a second conveying position. To transition the powder conveyor 49 into the cleaning position (see FIG. 15), the cylinder 1 and the cylinder 2 are being retracted. In the first conveying position, the powder conveyor 49 is situated above the storage space 31. For this purpose, the cylinder 1 is being retracted and cylinder 2 is being driven out. In the second conveying position, the powder conveyor 49 is situated above the storage space 32; the cylinders 1 and 2 are driven out. In the first conveying position, powder can be conveyed back into the powder carton 110, and, in the second conveying position, powder can be conveyed back into powder carton 111.

The suction lance 33 can be transitioned into three different positions by the linear axle 38 and the linear drive 44: In the cleaning position (see FIG. 15), the suction lance 33 is situated in the cleaning station 53.

In the first conveying position, the suction lance 33 is situated above the storage space 31 and, in the second conveying position, it is situated above the storage space 32.

In case of need, the fresh powder station 30 can just as well be equipped with its own controller 43. For example the suction lance 33, the cleaning station 52 for the suction lance 33, the linear axle 38, the linear drive 44, the pivoting mechanism 45, and the blow nozzles 56 and 57 can be controlled by said controller 43.

Figure 16:
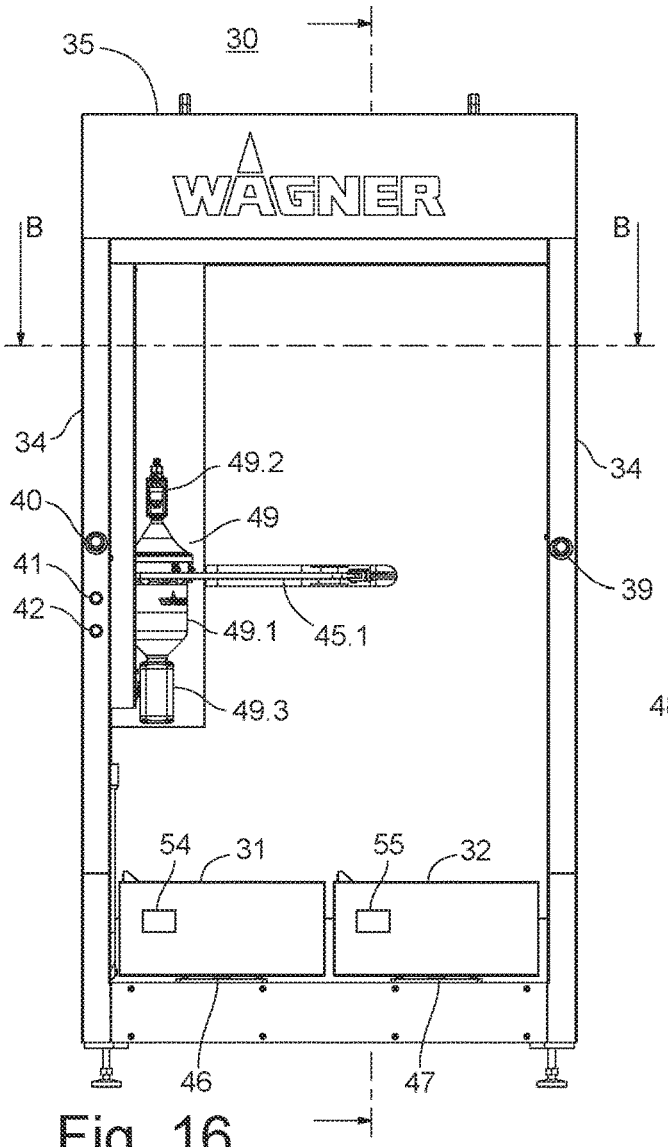
FIG. 16 shows a frontal view of the fresh powder station.

The powder conveyor 49 shown, for example, in FIGS. 16 and 18 is advantageously being positioned directly above the powder carton 110 or 111 into which it is to convey powder. Since it utilizes gravity, the powder drops into the powder carton situated below the powder conveyor 49 once the outlet valve 49.2 of the powder conveyor 49 is opened.

The powder conveyor 49 used for returning the powder can just as well be designed differently. For example, it can be designed as a powder pump. Since a powder pump of this type does not utilize gravity, it can be arranged in different places. For example, it can be situated at the same height level as the powder carton 110.

Two covers 35 and 36 that can be opened manually can be provided on the topside of the powder station 30. By this means, the staff also has access from above to the inside of the fresh powder station 30.

In case of need, the fresh powder station 30 can just as well be equipped with side walls 34 and a rear wall 48.

Figure 5:
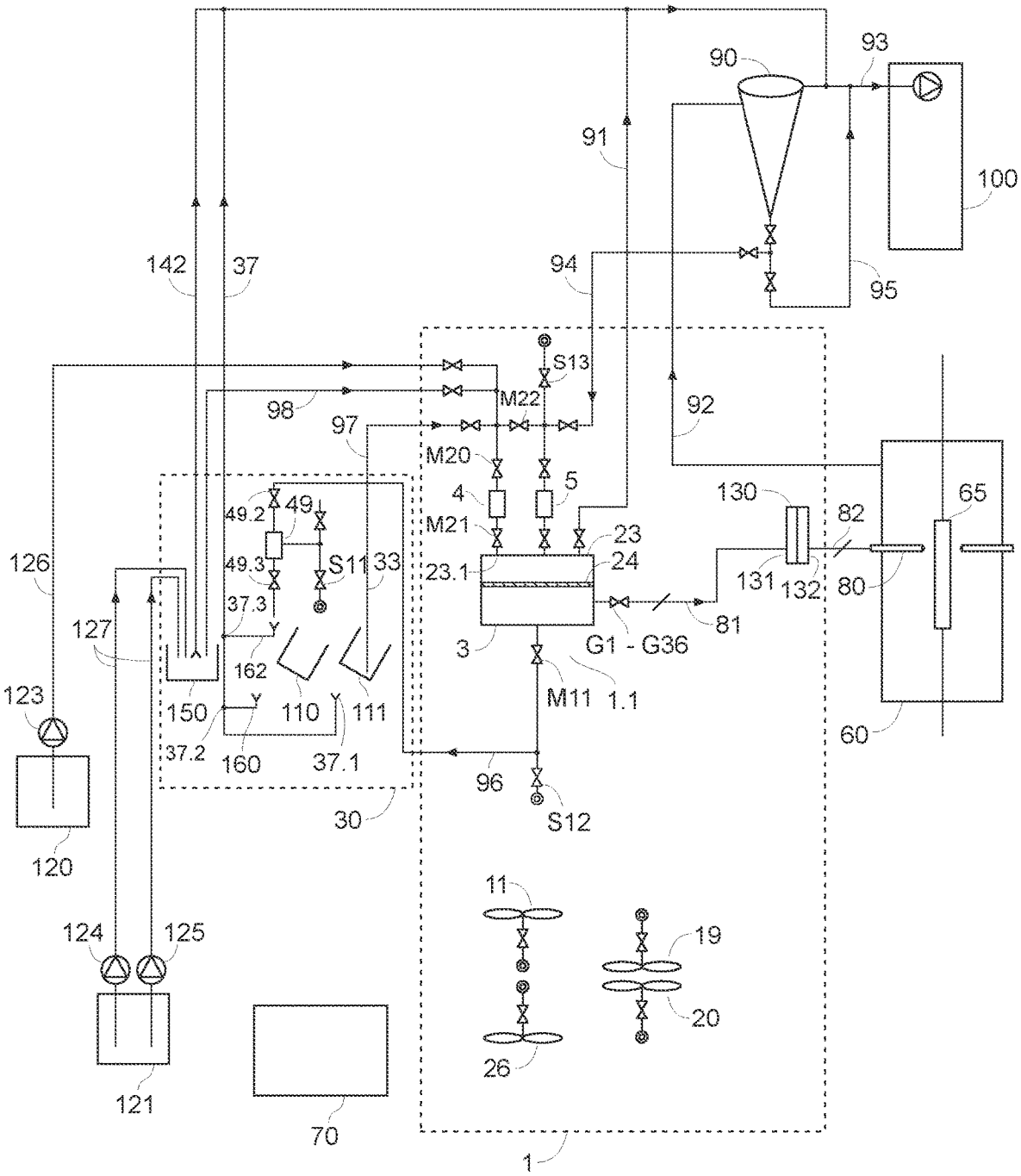
FIG. 5 shows a schematic block diagram of a possible embodiment of a powder coating facility with the coupling according to the invention.

One possible embodiment of a total facility for powder coating of workpieces 65 is shown in simplified manner as a block diagram in FIG. 5. The total facility can be controlled by means of a central controller 70. The controller 70 can be connected via corresponding control lines (not shown in the Figures) to various components of the total facility and can be provided for controlling the powder coating cabin 60 including powder applicators 80, the fresh powder station 30, the powder center 1, the powder recycling 90, and/or the after-filter 100.

Alternatively or in addition to the central controller 70, the fresh powder station 30 can comprise a separate controller 43, as has been mentioned above. The same applies analogously to all other components of the total facility for the coating of workpieces with powder.

Since all powder particles sprayed by the powder applicators 80 do not adhere to the workpieces 65 to be coated during the coating process, the excess powder, which is also referred to as overspray, needs to be removed from the cabin 60. This is necessary, firstly, because the surrounding area outside of the cabin needs to be kept free of powder dust. Secondly, the explosion hazard increases when a certain powder concentration is exceeded by the powder dust cloud floating in the cabin. This needs to be prevented.

The overspray arising during the coating and the air present in the cabin 60 are suctioned out of the cabin 60 as a powder-air mixture and are fed to a device for powder recovery 90 via a residual powder pipeline 92. The device for powder recovery 90 can be designed, for example, as a cyclone. The powder recovered therein can be fed to the powder center 1 again via a powder line 94 in case of need. In order to also remove, by filtering, the fraction of powder that was not removed, by filtering, in the cyclone 90, the powder-air mixture can be fed from the cyclone via a suction line 93 to the after-filter 100.

The powder-air mixture in the residual powder pipeline 92 is also referred to as residual powder air flow. For aspiration of the overspray out of the cabin 60, the cabin 60 comprises, for example, a suction slit. It connects the inside of the cabin 60 to the residual powder pipeline 92. The suction slit and the suction tube 61 are therefore used to aspirate excess powder from the inside of the cabin as a powder-air mixture and to feed it to a cyclone separator 90, or cyclone for short, that can be designed as a mono-cyclone. The powder-air mixture flows tangentially into the cyclone 90 and flows spirally downward inside the cyclone. In the process, the powder particles are pushed outwards against the outer wall of the cyclone 90 by the centrifugal force that arises during the rotation of the powder-air flow. The powder particles are conveyed downwards in the direction of the powder outlet of the cyclone, and are collected there. The air from which the powder particles have been removed is aspirated via the vertical central tube that is situated in the cyclone 90. Thus cleaned, the air flow is often fed to an after-filter 100 in order to remove, by filtering, even the last residual powder present in the air. The powder recycled in the cyclone 90 can be re-used for coating and can be fed to the powder center 1 via the powder line 94.

Conveying Mode/Conveying Operation

Figure 6:
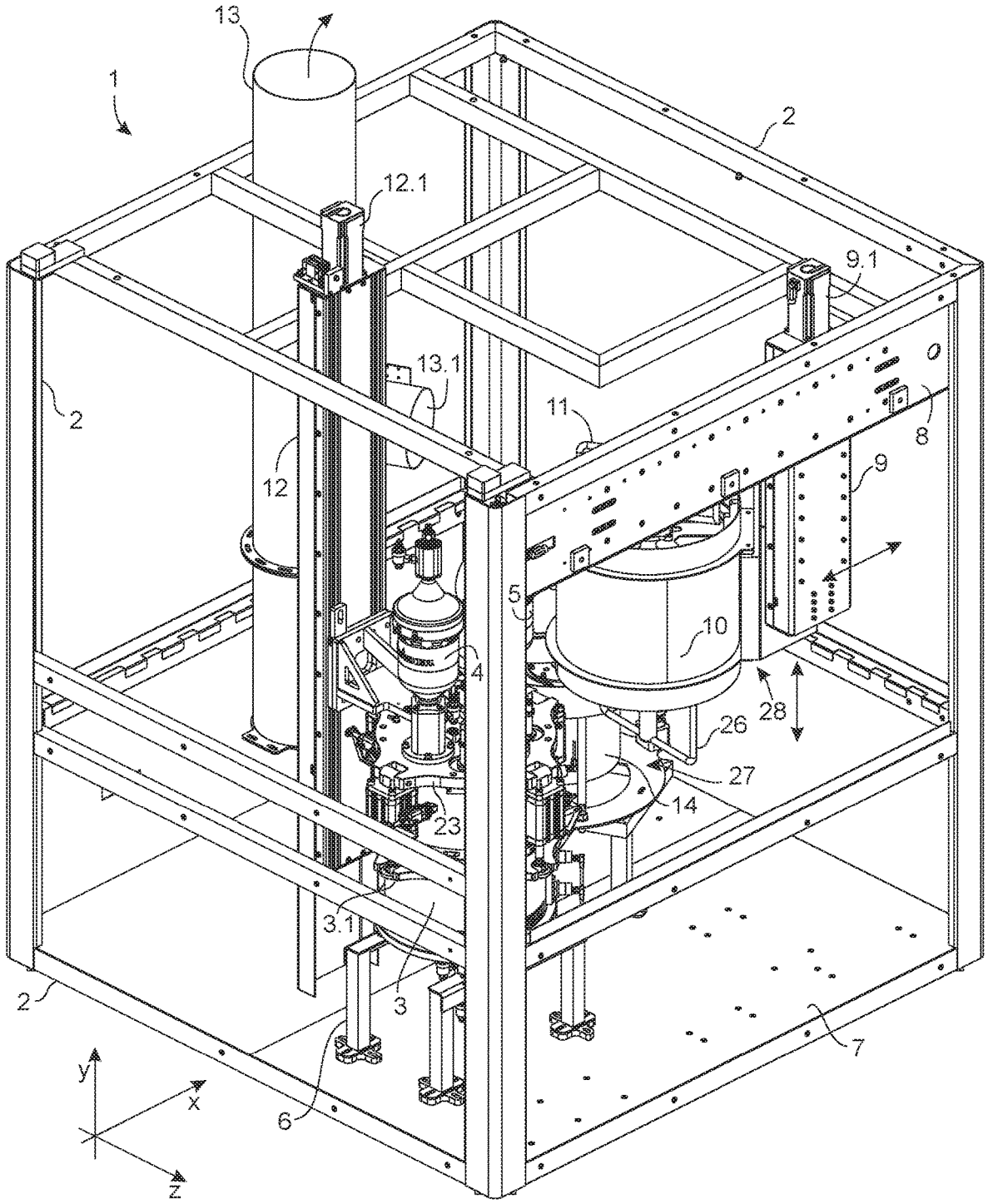
FIG. 6 shows a first three-dimensional view of a first possible embodiment of the powder center according to the invention in powder conveying mode.
Figure 7:
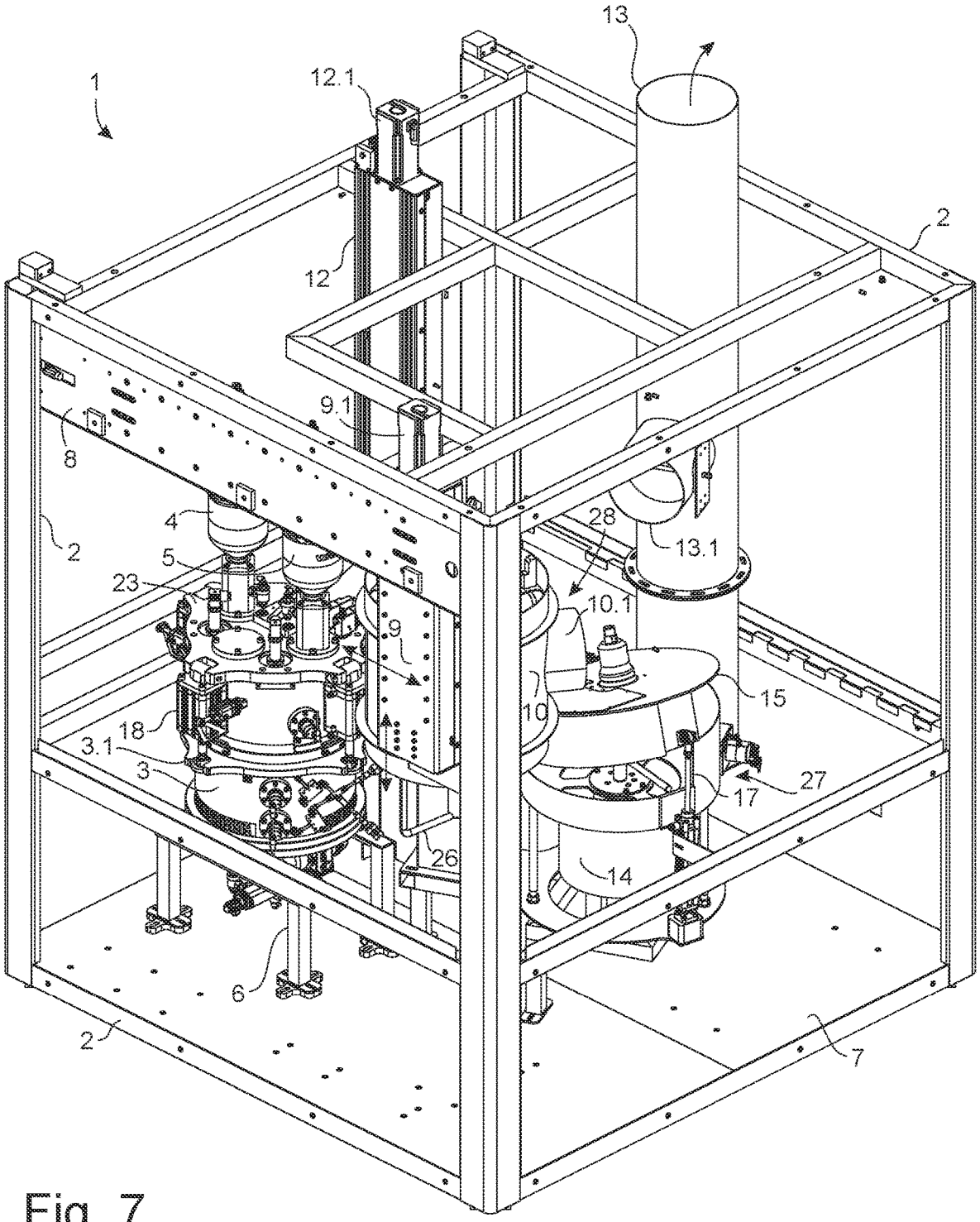
FIG. 7 shows a second three-dimensional view of the first embodiment of the powder center according to the invention.
Figure 8:
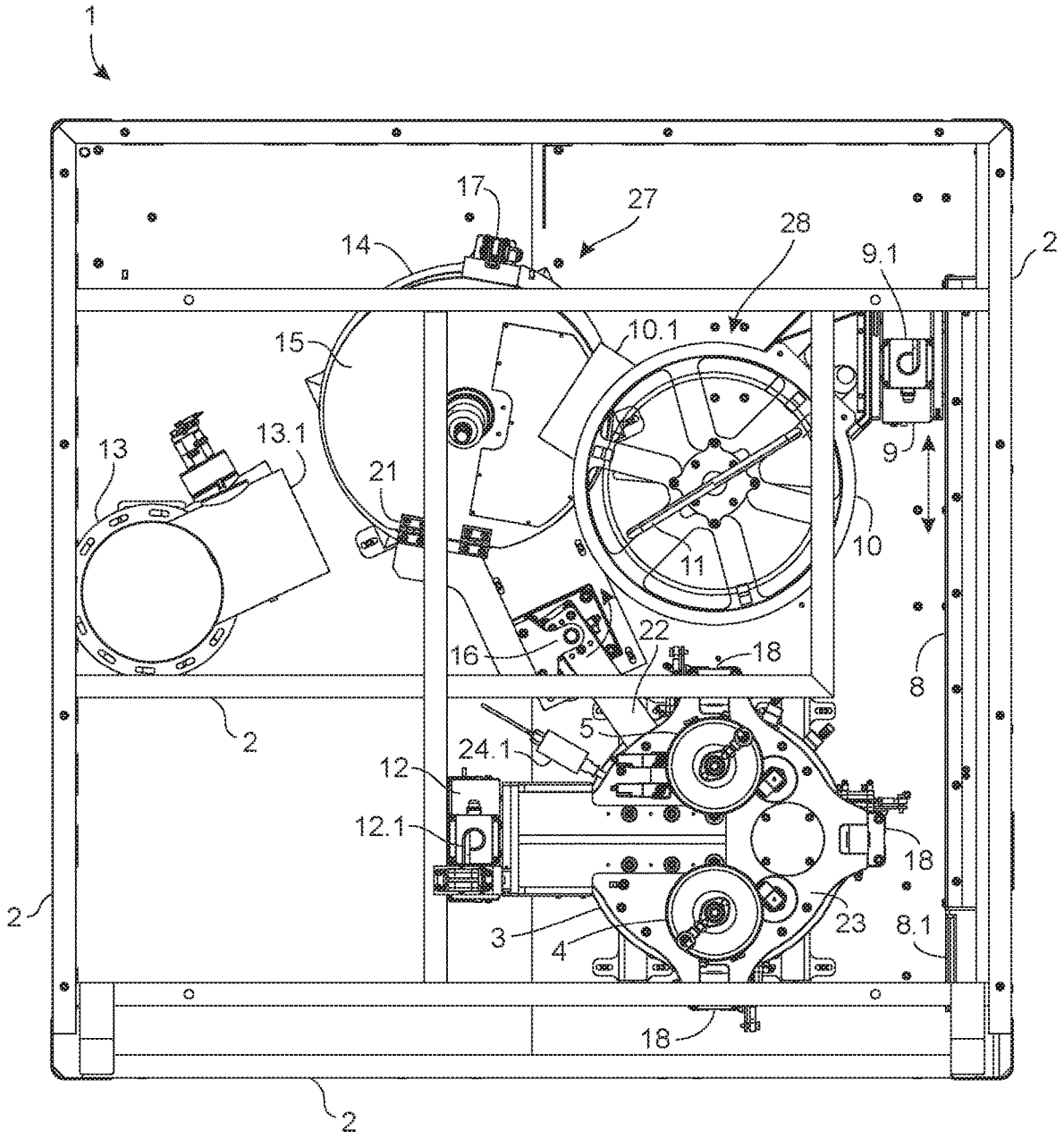
FIG. 8 shows a top view of the powder center according to the invention.
Figure 9:
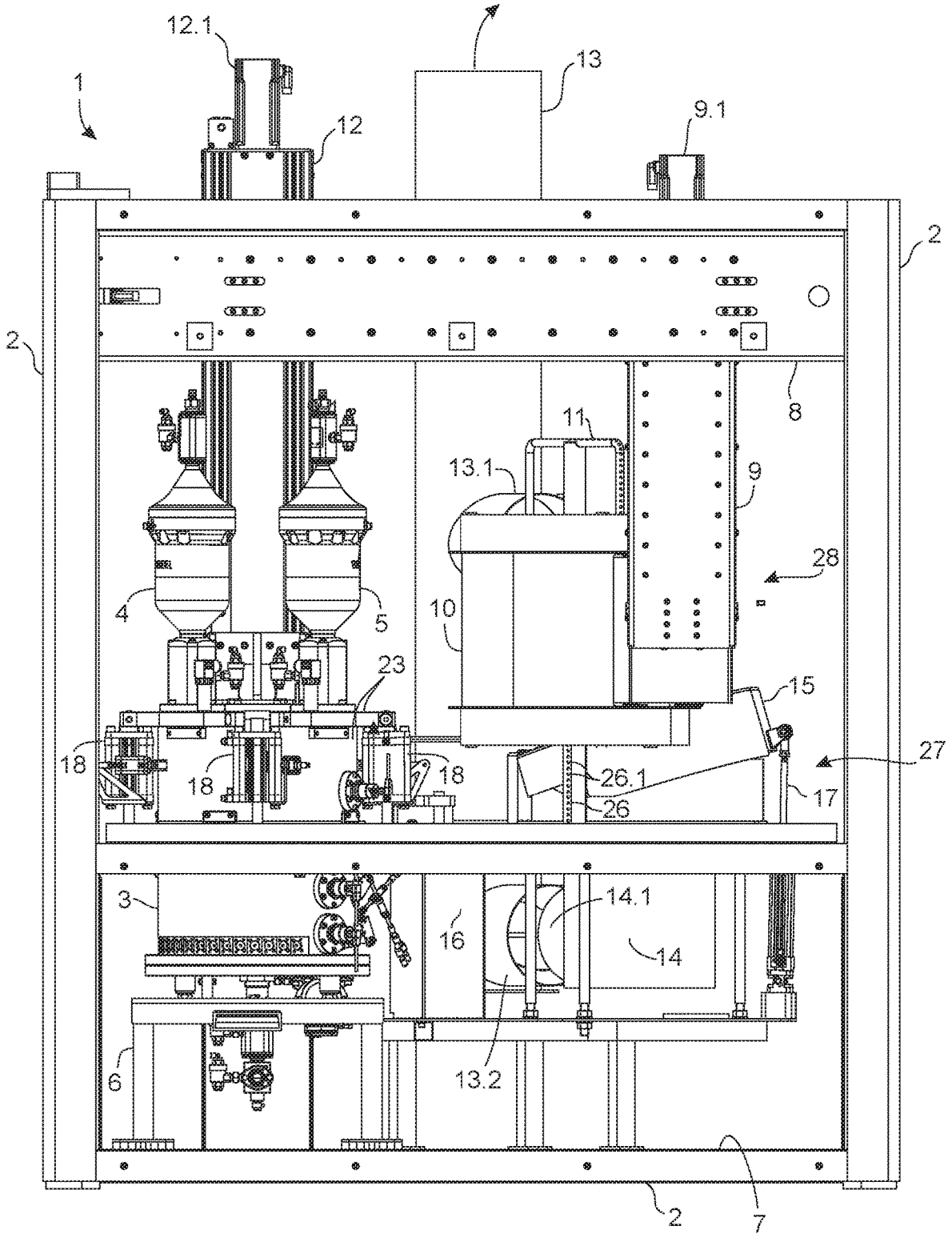
FIG. 9 shows a first side view of the powder center according to the invention.

In conveying mode, the ultrasound screen 24 is situated in the working container 3, 23, between the powder reservoir container 3 and the powder container lid 23. The locks 18 make sure that the working container is closed in airtight manner. The screen cleaning device 27 and the container cleaning unit 28 are situated in the parking position, as shown in FIGS. 6 to 8.

The parking position for the container cleaning unit 28 is situated next to the powder reservoir container 3. The term «next to the powder reservoir container» shall also comprise above, below, in front of or behind the powder reservoir container.

The screen 24 is not obligatory for conveying mode. The conveying of powder can also take place without an ultrasound screen or without a screen 24 altogether.

Cleaning Mode/Cleaning Operation

For switching from conveying mode to cleaning mode, the conveying of powder out of the powder reservoir container 3 is stopped and the residual powder that is still present in the powder reservoir container 3 is aspirated via the outlet 25.1 and the line 96 by means of the powder conveyor 49. For this purpose, the material valve M11 is being opened, while the purging valve S12 is closed during this time. The overpressure that is still prevailing in the working container 3, 23 is reduced to normal pressure and the locks 18 are opened.

Then, the powder container lid 23 is lifted by means of the linear drive 12 and the ultrasound screen 24 is pivoted out of the working position into the cleaning position by means of the pivoting mechanism 16.

Figure 12:
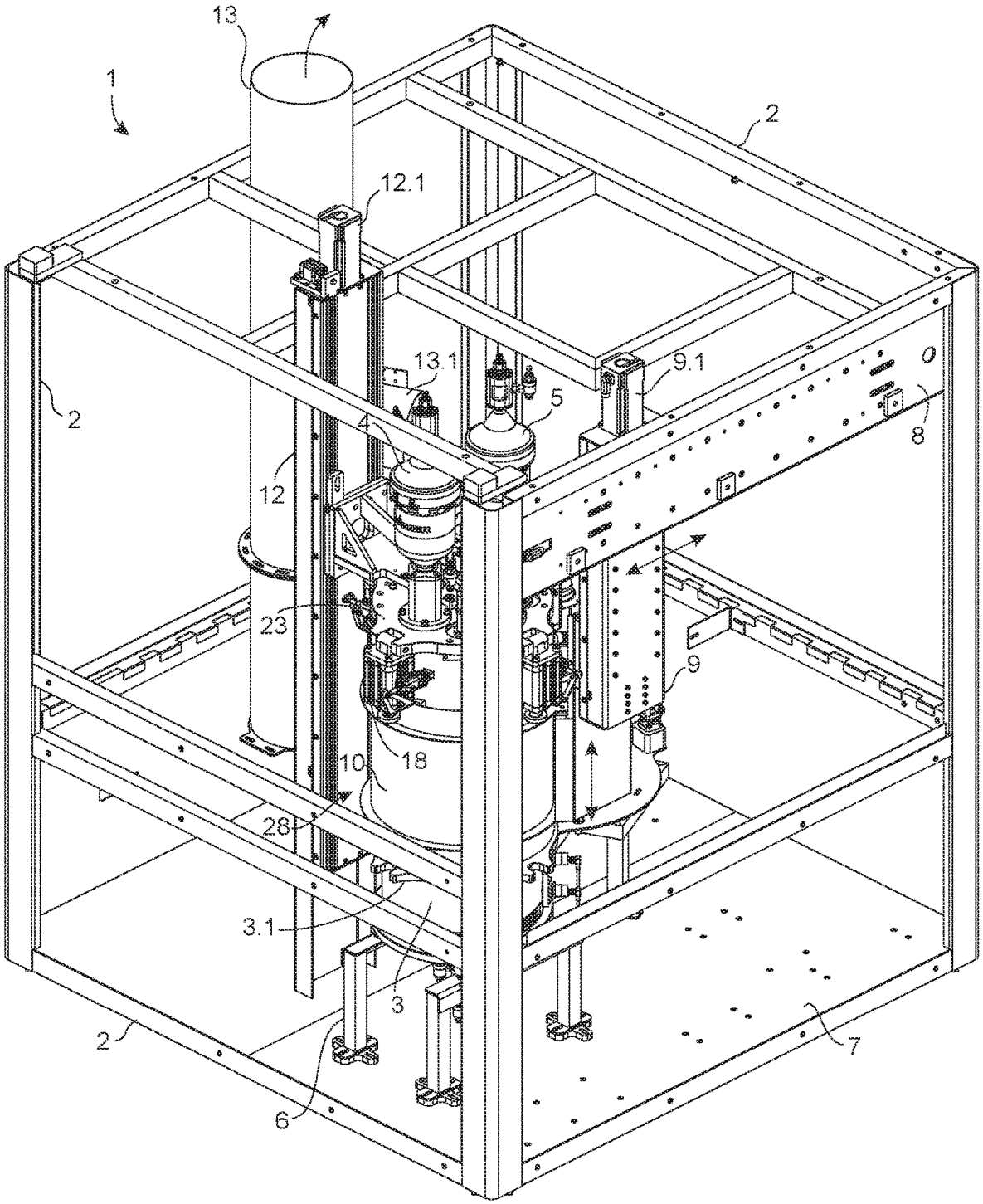
FIG. 12 shows a first three-dimensional view of the powder center according to the invention in cleaning mode.
Figure 13:
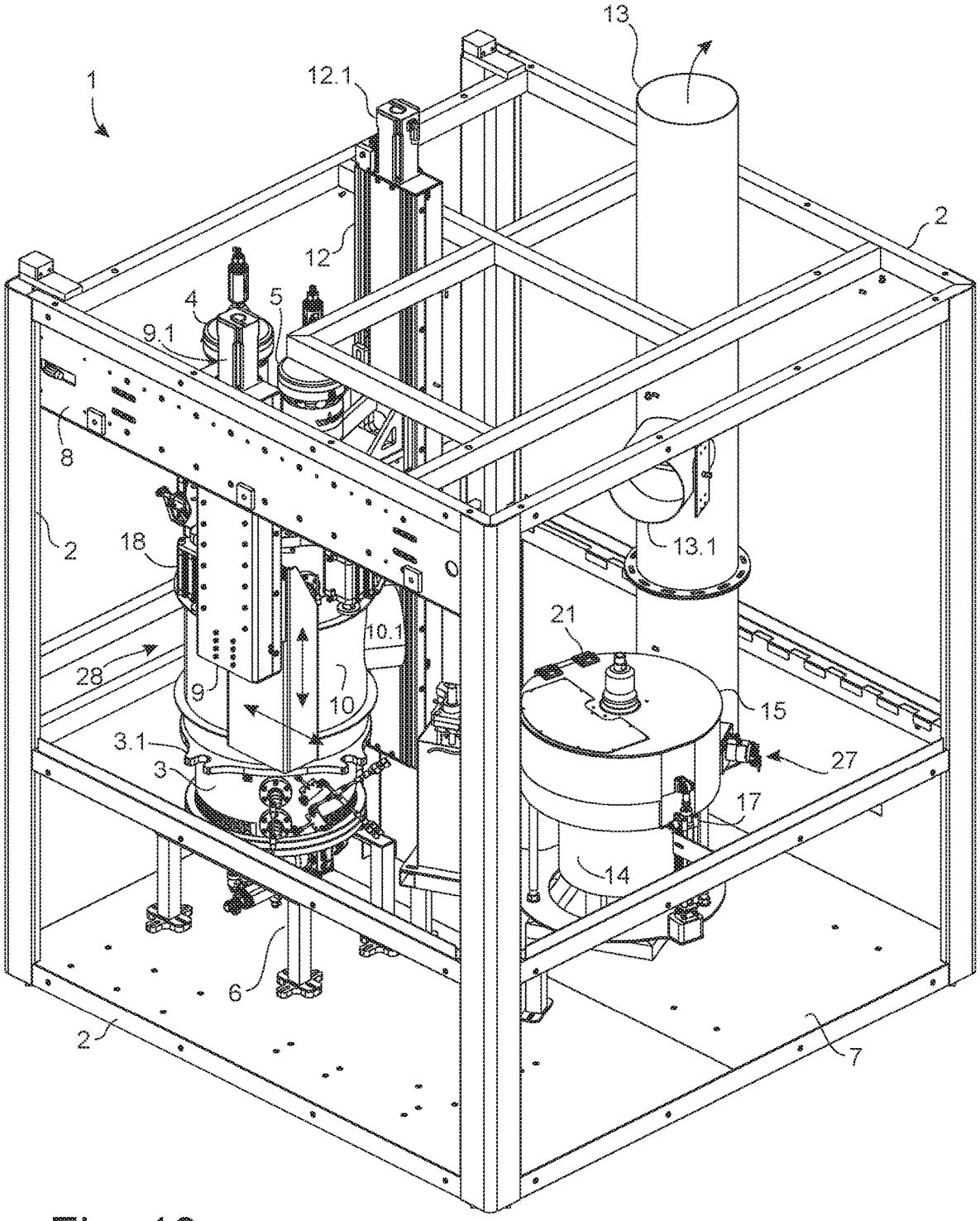
FIG. 13 shows a second three-dimensional view of the powder center according to the invention in cleaning mode.
Figure 14:
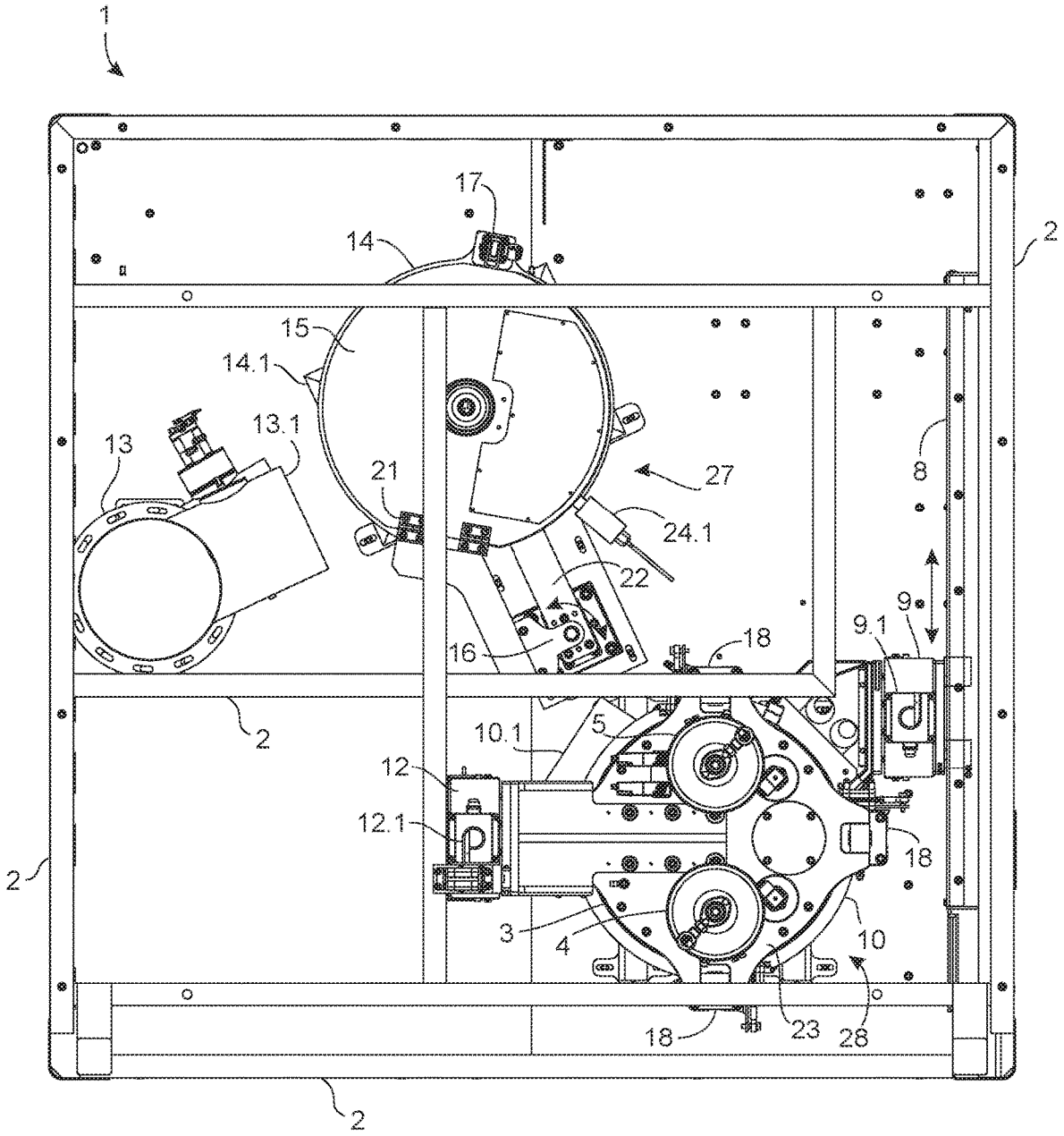
FIG. 14 shows a top view of the powder center according to the invention in cleaning mode.
Figure 15:
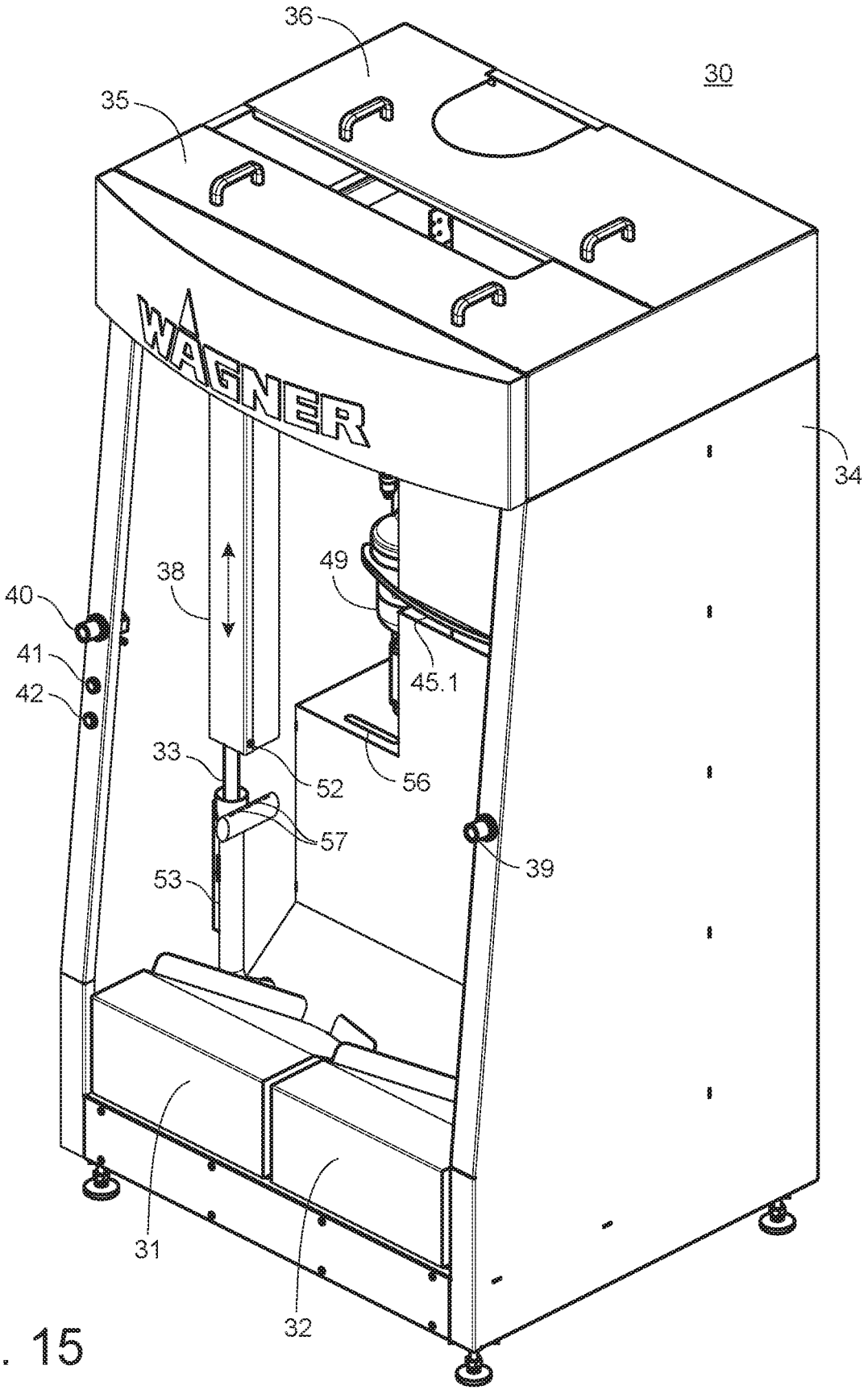
FIG. 15 shows a three-dimensional view of a possible embodiment of a fresh powder station.

As shown in FIGS. 12 to 14, the linear drive 12 lifts the container lid 23 to the extent such that the cleaning container 10 can be driven in between the powder container lid 23 and the powder reservoir container 3 by the two linear axles 8 and 9. Subsequently, the container cleaning unit 28 including the cleaning container 10 is lowered sufficiently until the lower cleaning arm 26 is situated on the inside of the powder reservoir container 3 and is situated at a defined distance from the base 25 of the powder reservoir container 3.

The powder container lid 23 is then lowered to the extent such that the upper cleaning arm 11 is situated on the inside of the powder container lid 23 and is situated at a defined distance from the powder container lid 23.

In the embodiment above, an air gap remains between the powder container lid 23 and the cleaning container 10. Likewise, an air gap remains between the powder container 3 and the cleaning container 10. The after-filter 100 aspirates air through the air gap. This prevents the powder-air mixture generated by the compressed air nozzles 11.1 and 26.1 during the cleaning process from escaping into the surroundings.

Instead, it is feasible just as well to lower the powder container lid 23 to the extent such that no gap remains between the powder container lid 23 and the cleaning container 10. Likewise, the gap between the cleaning container 10 and the powder container 3 can be eliminated by lowering the cleaning container 10 to the extent such that it is placed on top of the powder container 3.

In another embodiment, the locks 18 can close the unit made up of powder container lid 23, cleaning container 10, and powder reservoir container 3, in airtight manner.

In a next step, compressed air is blown through the nozzles 11.1 and 26.1 in the direction of the inner walls of the powder container lid 23 and of the powder reservoir container 3. The powder-air mixture thus generated is aspirated via the suction line 13 and can be fed to the cyclone 90 and/or to the after-filter 100.

As soon as the screen 24 and/or the ultrasound screen is situated in the cleaning container 14, the lid 15 is closed by means of the pneumatic cylinder 17. An air gap can remain between the lid 15 and the cleaning container 14. In another embodiment, the lid 15 can just as well be placed on the cleaning container 14 in airtight manner.

Now, compressed air is being blown through the nozzles 19.1 and 20.1 from above and below onto the screen 24. The powder-air mixture thus generated is aspirated via the suction line 13 and can be fed to the cyclone 90 and/or to the after-filter 100.

As soon as the screen 24 is clean, the blowing off of the screen is terminated. Once the powder container 3 and the container lid 23 are clean, the blowing off is terminated here as well.

If the locks 18 had previously been closed, they are now being opened again. The container lid 23 is being lifted and the container cleaning unit 28 is being moved back into the parking position (see FIGS. 6-9). The lid 15 is being lifted as well. Once the cleaning mode is completed, the screen 23 is driven back into its working position. Subsequently, the conveying of powder can be started again.

Cleaning Mode with Intensive Cleaning

The following cleaning steps can be carried out in order to clean the powder center 1 and the other components of the facility contacting the coating powder even more thoroughly. The steps are preferably carried out automatically and are coordinated by the controller 70. The cleaning unit 28 is used to clean the powder reservoir container 3 and the container lid 23, as described above. In a further step, a switch to a different coating powder is carried out. The other coating powder in this context can be the powder that is the next to be used for coating the workpieces 65. But this does not necessarily have to be the case. Instead, a switch to a special cleaning agent can be carried out just as well. The cleaning agent can be, for example, a granulate with a grain size between 2 mm and 7 mm. The grain size, the grain material, and the grain properties are preferably selected appropriately such that, firstly, the cleaning agent can be conveyed through all openings in the powder system and, secondly, has a good cleaning effect. The selection of the cleaning agent advantageously takes into consideration that no additional wear and tear in the powder system and no chemical incompatibility with the coating powder arises.

In an additional step, a switch to conveying mode is effected for a limited period of time such that the other coating powder and/or the cleaning agent flows through the individual components of the facility. During the brief conveying mode, for example 3 kg of powder that are ultimately lost can be conveyed. But it is also feasible to recover the material (the powder and/or the cleaning agent) in the cyclone 90. As a result, the powder lines 91, 92, 93, and 94 can also be purged with the new material. This is of advantage, in particular, if the new powder is conveyed to be recovered.

Subsequently, the powder reservoir container 3 and the container lid 23 are cleaned again by means of the cleaning unit 28.

The preceding description of exemplary embodiments according to the present invention serves for illustrative purposes only. Various changes and modifications are feasible within the scope of the invention. Accordingly, for example, the various components of the coupling and of the powder center shown in FIGS. 1 to 18 can be combined with each other in a way different from what is shown in the Figures.

LIST OF REFERENCE NUMBERS

1 Powder center
1.1 Powder conveyor
2 Frame profiles
3 Powder reservoir container
3.1 Lock receptacle
3.2 Outlet opening for powder
3.3 Compressed air connector for purging air
3.4 Powder outlet
4 Powder conveyor
4.2 Powder outlet
5 Powder conveyor
6 Pedestal
7 Base sheet
8 Linear drive
8.1 Drive motor
9 Linear drive
9.1 Drive motor
10 Cleaning container
10.1 Outlet
11 Cleaning arm for the lid
11.1 Cleaning nozzles
12 Linear drive
12.1 Drive motor
13 Suction line/suction tube
13.1 Inlet opening
13.2 Inlet opening
14 Screen cleaning container
14.1 Outlet
14.2 Lower container section
15 Lid of the screen cleaning device
16 Pivoting mechanism
17 Lifting cylinder
18 Lock
19 Cleaning arm
19.1 Screen cleaning nozzles
20 Cleaning arm
20.1 Screen cleaning nozzles
21 Hinge
22 Support arm for the powder screen
23 Container lid
23.1 Powder inlet
24 Ultrasound screen
24.1 Ultrasound transducer
25 Container base
25.1 Fluidizing insert
25.2 Outlet
26 Cleaning arm for the powder reservoir container
26.1 Cleaning nozzles
27 Screen cleaning device
28 Cleaning unit/container cleaning unit
30 Fresh powder station
31 First storage space
32 Second storage space
33 Suction lance
34 Side wall
35 Cover
36 Cover
37 Suction system
37.1 Suction opening
37.2 Suction opening
37.3 Suction opening
38 Linear axle for the suction lance
39 Compressed air regulating valve
40 Compressed air regulating valve
41 Adjusting knob
42 Adjusting knob
43 Controller
44 Linear drive
45 Pivoting mechanism for powder conveyor
45.1 Arm
46 Scale
47 Scale
48 Rear wall
49 Powder conveyor
49.1 Powder container
49.2 Inlet valve for powder
49.3 Outlet valve for powder
49.11 Inlet
49.12 Outlet
50 Bearing
51 Bearing
52 Cleaning station
53 Cleaning station
54 Vibrator
55 Vibrator

56 Compressed air nozzle
57 Compressed air nozzle
60 Powder coating cabin
65 Workpiece
70 Controller
71 Control line
80 Powder spray gun
81 Powder lines
81.1 First powder line
81.2 Second powder line
81.3 Third powder line
82 Powder lines
82.1 First powder line
82.2 Second powder line
82.3 Third powder line
83 Compressed air line
84 Compressed air line
90 Powder recovery
91 Suction line
92 Suction line
93 Suction line
94 Powder line
95 Suction line
96 Powder return line
97 Powder line
98 Powder line
100 After-filter
110 Powder carton
111 Powder carton
120 Big Bag
121 Big Bag
123 Powder pump
124 Powder pump
125 Powder pump
126 Powder line
127 Powder line
130 Coupling
130.1 Arrow
130.2 Arrow
131 First group of connectors
131.1 First connector of the first group
131.2 Second connector of the first group
131.3 Third connector of the first group
132 Second group of connectors
132.1 First connector of the second group
132.2 Second connector of the second group
132.3 Third connector of the second group
133 Drive
133.1 Pneumatic cylinder
133.2 Piston
133.3 Compressed air control connector
133.4 Compressed air control connector
133.5 Connecting stud
133.6 Rod
134 Drive
134.1 Pneumatic cylinder
134.2 Piston rod
134.3 Compressed air control connector
134.4 Compressed air control connector
134.5 Hinge
134.10 Pneumatic cylinder
134.11 Piston rod
135 Coupling disc
135.1 Channels
135.2 Bracket
135.3 Spacer
135.4 Socket
135.5 Socket
136 Coupling disc
136.1 Channels
136.2 Positioning pin
137 Seal
138 Axle
138.1 Compressed air connector
138.2 Air channel
138.3 Air channel
138.4 Bearing socket
139 Stand
141 Residual powder line
142 Residual powder line
150 Intermediate container for powder
160 Suction opening
162 Suction opening
183.1 Compressed air connector
183.2 Compressed air connector
184.1 Compressed air connector
184.2 Compressed air connector
220 Vibrator
M11 Valve for powder material
M20 Inlet valve for powder
M21 Outlet valve for powder
M22 Valve
r1 Radius
r2 Radius
r3 Radius
S11 Purging valve
S12 Purging valve
S13 Purging valve
T1 First pitch circle
T2 Second pitch circle
T3 Third pitch circle
V1 Valve
V2 Control valve
V3 Control valve
V4 Control valve
V5 Control valve
V11 Valve
V12 Valve
G1-G36 Outlet valves
x x-axis
y-axis
Y
z z-axis
α Angle of rotation
Ax Stroke

The invention claimed is:

1. A powder coating facility comprising a coupling for connecting of lines, wherein a first coupling disc with first line connectors and a second coupling disc with second line connectors is provided, wherein a first drive is provided that is configured to move the first and second coupling discs axially with respect to each other, wherein a second drive is provided that is configured to rotate the first and second coupling discs with respect to each other, wherein a powder conveyor is provided that is connected to one of the first line connectors of the coupling by way of a powder line, wherein a powder applicator is provided that is connected to one of the second line connectors of the coupling by way of a further powder line, wherein a compressed air purging line that is connected to the coupling is provided, wherein the compressed air purging line is connected to one of the second line connectors of the coupling, and wherein a further compressed air purging line that is connected to one of the first line connectors of the coupling is provided.

2. The powder coating facility according to claim 1 wherein the first and second coupling discs are arranged such as to be coaxial.

3. The powder coating facility according to claim 1, wherein the first coupling disc comprises first axial channels, which each are connected to one of the first line connectors each, wherein the second coupling disc comprises second axial channels, which each are connected to one of the second line connectors each, and wherein one seal each is arranged between the first axial channels and the second axial channels.

4. The powder coating facility according to claim 3 wherein the seals are designed to be sleeve-shaped.

5. The powder coating facility according to claim 1, wherein an axle attached to the first coupling disc is provided and forms a rotary axis for the second coupling disc.

6. The powder coating facility according to claim 5, wherein an axle bearing is provided between the axle and the second coupling disc, and wherein the axle bearing comprises an air purge system.

7. The powder coating facility according to claim 1, wherein at least a part of the first line connectors are arranged on a first pitch circle.

8. The powder coating facility according to claim 7, wherein a further part of the first line connectors are arranged on a second pitch circle.

9. The powder coating facility according to claim 1, wherein the first drive and/or the second drive comprises a pneumatic cylinder.

10. The powder coating facility according to claim 1, wherein the at least one part of the first and/or of the second line connectors is designed as hose nozzles.

11. The powder coating facility according to claim 1, wherein the one coupling disc comprises a positioning pin and the other coupling disc comprises sockets for accommodation of the positioning pin.

12. The powder coating facility according to claim 1, wherein at least one spacer is provided between the first and second coupling discs.

13. A method for cleaning of the powder coating facility according to claim 1, wherein the first and second coupling discs are arranged appropriately with respect to each other such that the compressed air purging line is connected to the powder line by way of the coupling, wherein the powder line is purged in the direction of the powder conveyor by compressed air.

14. The method for cleaning of the powder coating facility according to claim 13, wherein the first and second coupling discs are arranged appropriately with respect to each other such that the further compressed air purging line is connected to the powder applicator by way of the coupling and the further powder line, wherein the further powder line is purged in the direction of the powder applicator by compressed air.

* * * * *